United States Patent [19]

Sturdevant

[11] Patent Number: 4,496,827

[45] Date of Patent: Jan. 29, 1985

[54] ENHANCED HEAT AND MASS TRANSFER APPARATUS

[75] Inventor: Eugene J. Sturdevant, Wilmington, Del.

[73] Assignee: Proctor-Silex, Inc., Chillicothe, Ohio

[21] Appl. No.: 488,556

[22] Filed: Apr. 25, 1983

[51] Int. Cl.[3] ..... F28F 13/16

[52] U.S. Cl. ..... 219/399; 165/96; 219/404; 219/395; 219/396; 425/174.8 E

[58] Field of Search ..... 219/399, 392, 402, 404, 219/10.81, 391, 394, 395, 396, 397, 398, 403, 280, 281; 165/1, 96; 174/16 R; 361/229, 230; 264/22, 25, 26, 27; 250/324, 325, 326; 422/186.04; 425/174.4, 174.6, 174.8 E, 174.8 R

[56] References Cited

U.S. PATENT DOCUMENTS

| | | | |
|---|---|---|---|
| 3,203,809 | 8/1965 | Visness | 250/326 |
| 3,526,268 | 9/1970 | Robinson | 165/1 |
| 3,794,111 | 2/1974 | Blomgren | 165/1 |
| 4,015,658 | 4/1977 | Kibler | 165/1 |
| 4,238,668 | 12/1980 | Mammen | 219/399 |

FOREIGN PATENT DOCUMENTS

| | | | |
|---|---|---|---|
| 1579487 | 2/1970 | Fed. Rep. of Germany | 219/395 |
| 2414907 | 10/1974 | Fed. Rep. of Germany | 250/325 |

*Primary Examiner*—Roy N. Envall, Jr.
*Assistant Examiner*—Teresa J. Walberg
*Attorney, Agent, or Firm*—Frost & Jacobs

[57] ABSTRACT

An apparatus in a cooking device, e.g., an oven, is disclosed for enhancing heat and mass transfer during the food cooking process. The apparatus applying differently controlled corona currents to food surfaces in order to reduce cooking times relative to cooking times of conventional ovens. Two low potential electrodes, one fixed and the other movable, are provided in the oven and food, located intermediate the electrodes, is maintained at a high potential. A pair of electrically conductive fields for supporting corona currents at predetermined different corona current densities are defined between each electrode and its nearest food surface. Electrical circuitry is provided for maintaining a constant corona current flow in each one of the two electrical fields and each electrical field is controlled to support corona current flow at a different optimum density found to maximize heat and mass transfer. In operation, the corona current density in one electrical field is electrically monitored to adjust the high potential supplied to the food in order to maintain optimum corona current density in that electrical field. The corona current density in the other electrical field is electrically monitored to electromechanically adjust the movable electrode towards and away from the food, according to the high potential of the food, in order to maintain optimum corona current density in the other electrical field.

12 Claims, 13 Drawing Figures

ENHANCED HEAT AND MASS TRANSFER APPARATUS

BACKGROUND OF THE INVENTION

1. Field of the Invention

This invention relates to apparatus used in cooking devices, i.e., ovens of the type employing heat elements to cook the food through a convective and conductive heat transmitting cooking process. More particularly, the invention concerns apparatus for maximizing the transfer of heat and mass during the cooking process so that relative cooking times of foods are reduced.

2. Description of the Prior Art

In ovens of the aforementioned type, a film or thin layer of stagnant air is known to adherently form at outer exposed food surfaces during the cooking process. This film acts as an insulator that effectively impedes rapid transfer of heated air molecules to the food. Conversely, rapid transfer of mass molecules, i.e., moisture, away from the food is also restricted by this insulating film. Consequently, the overall cooking efficiency of the oven is hindered by the formation of the stagnant layer of air.

Ways of improving heat transfer to overcome the thermal insulating problem posed by the film are addressed in the prior art. A particular solution to this problem is suggested in U.S. Pat. No. 4,238,668, granted to H. William Mammen on Dec. 9, 1980. Mammen discloses an oven fixedly equipped with a pair of fixed conductive guide ledges operatively maintained at a fixed—non-variable—DC potential. A conductive field grid element is maintained at a different fixed—non-variable—DC potential with respect to the ledges. A conductive food supporting rack or tray removably bridges the guide ledges so that an electrical field is created between the field grid element and the food on the rack or tray during the cooking process. The field grid element and the ledges are operated at different potentials for supporting current flow in the field. The grid element is made manually adjustable to accommodate different food sizes. Adjustment of the field grid element is made prior to cooking, and after it is adjusted, the grid element remains stationary in the oven throughout the cooking process.

The apparatus taught in Mammen improves heat transfer in conventional ovens. However, it suffers from a number of deficiencies among which is the requirement that the operator at least check and if needed to make the adjustment of the grid element prior to all cooking operations. This responsibility is a nuisance and a burden for the operator. Another disadvantage is that there are no practical means provided for moving the grid element to compensate for foods that change in volume during the cooking process, e.g., bread dough that rises. Yet another deficiency is attributed to the failure of Mammen to recognize the importance of maintaining constant current in the field to maximize the heat and mass transfer. This is evident because he fails to disclose voltage adjusting means that automatically changes the field current to compensate for electrical impedance in the field air that is changing during the cooking process. Consequently, maximum heat transfer is not accomplished during the entire cooking duration. Still another deficiency resides in the improved heat transfer apparatus being only applied at one food surface. This allows the heat retarding film to form along the remaining food surfaces to restrict heat transfer at those surfaces.

From the foregoing, it is understood that apparatus of the prior art falls short of providing maximum heat and mass transfer performance. In view of the prior art deficiencies, it is further understood that there is a need to make a more efficient heat and mass transfer apparatus which is more convenient for the operator to use.

SUMMARY OF THE INVENTION

The present invention sets forth apparatus in a cooking device that operates to provide continued enhance heat and mass transfer throughout all cooking operations. Moreover, this is accomplished in an automatic manner without requiring undue operator attention.

To achieve this the apparatus includes a pair of low potential electrodes having food to be cooked maintained at a high potential. The food is supported on electrically insulative rods situated intermediate the electrodes. A variable high voltage supply is electrically connected to an electrical conducting probe made to be removably inserted directly into all foods for supplying high potential to the food. According to the preferred arrangement, one electrode is fixed and the other electrode is movable with respect to the food. The fixed electrode is located in spaced relation beneath the food to define a first electrical field for supporting a found optimum corona current density. An electrical circuit includes a constant current high voltage control circuit operable to monitor corona current present in the first field and to transmit therefrom an electrical signal to the high voltage supply. The electrical signal is utilized in the high voltage supply to adjust its voltage output to the food. The voltage to the food is regulated to maintain optimum corona current density in the first field. The movable electrode is adjustably suspended above the food to define a second electrical field for supporting another found optimum corona current density. An electrode adjusting circuit includes a motor control circuit, a motor drive circuit and a motor operable for moving the movable electrode through operation of a mechanical drive means towards and away from the food. The motor control circuit is electrically connected to monitor corona current present in the second field and is connected to the motor drive circuit for activating the motor to adjustably move the electrode towards or away from the food in order to maintain the optimum corona current density in the second field.

It is known that by subjecting food being cooked to an electrical field supporting corona current, heat and mass transfer is improved. Applicant has discovered that by continually applying an optimum corona current density, having a small tolerance range, to the food the cooking efficiency of the oven is improved. Accordingly, the present apparatus is made to provide and maintain optimum corona current density in two electrical fields to maximize heat and mass transfer over the duration of the cooking process.

OBJECTS OF THE INVENTION

It is therefore an object of the present invention to provide apparatus in a cooking device that continually maximizes heat and mass transfer so as to minimize cooking times.

Another object of the present invention is to provide improved cooking apparatus that utilizes electrical fields supporting an optimum corona current density for efficient and fast cooking of foods.

A further object of the present invention is to provide enhanced heat and mass transfer oven apparatus that continually adjusts the voltage supplied to the food to compensate for changing electrical impedance in the oven air for maintaining a constant optimum current density in each electrical field throughout the cooking process.

Other advantages and features of the invention will become evident from the following description and claims taken in conjunction with the appended drawing.

DETAILED DESCRIPTION OF THE PREFERRED EMBODIMENT

Figure 1:
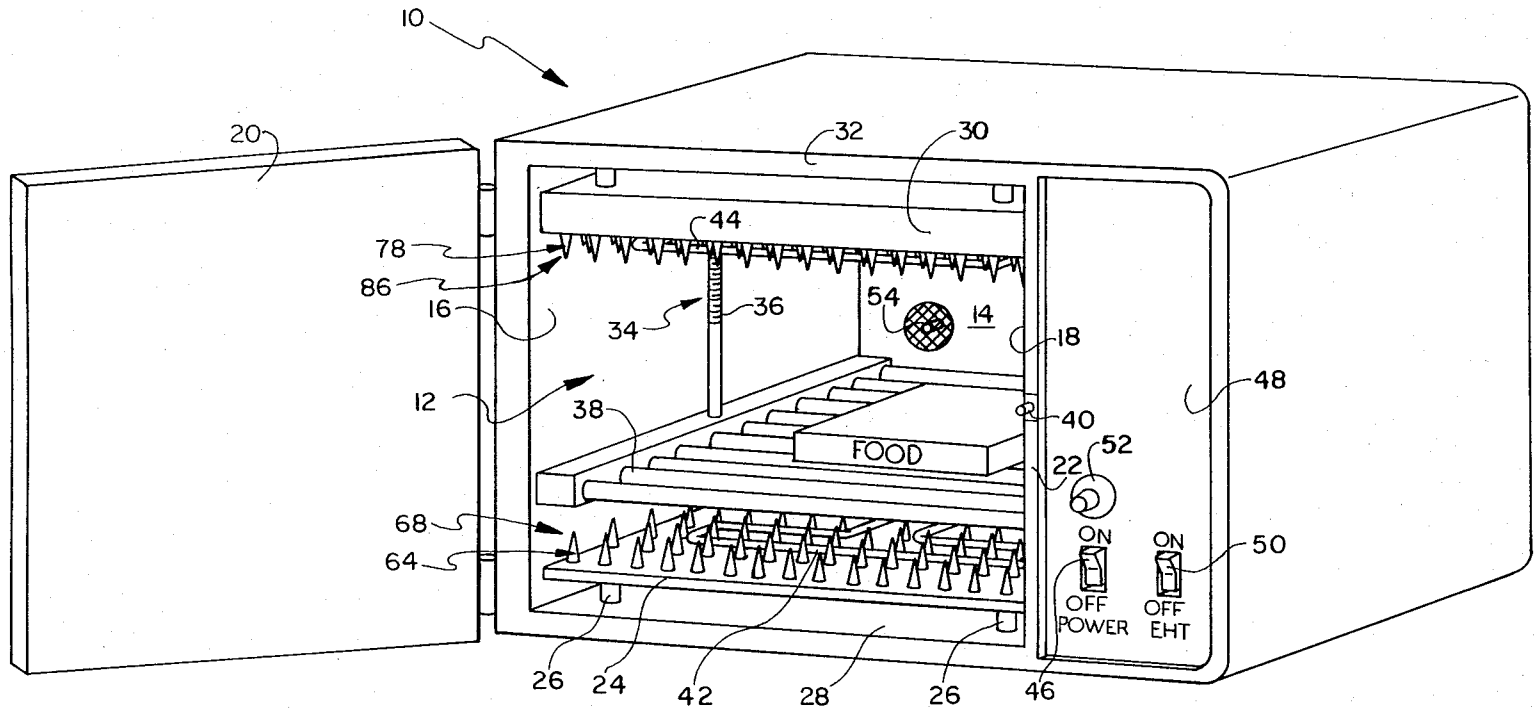
FIG. 1 is a front perspective view of an oven equipped with an apparatus constructed in accordance with the teachings of the present invention.

With reference to the drawings, there is shown in FIG. 1 a cooking device preferably an oven 10 having embodied therein apparatus constructed in accordance with the teachings of the present invention. Generally, oven 10 is built to house food for cooking in a box-shaped chamber 12 defined, in part, by a back wall 14 supporting spaced apart left and right side walls 16 and 18. A front door 20 is hinged to the wall 16 for manual manipulation between an open (shown) and a closed position wherein the door 20 is abutting an edge 22 of wall 18. A lower stationary plate 24 defines a lower boundary of the chamber 12. A plurality of legs 26 are attached to a base 28 of oven 10 for supporting the plate 24. An upper movable plate 30 defines an upper boundary of the chamber 12. This plate 30 is shown located to rest in a retract position near a top casing 32 of oven 10 when the disclosed system is OFF. The upper plate 30 is movable vertically by action of a drive mechanism means 34 including a rotatable drive screw 36 thread coupled to plate 30 as is described in detail below. It is understood that the actual cooking cavity size of the chamber 12 is made to vary according to adjustable vertical positions of the movable plate 30. A plurality of elongated electrical insulator rods 38 are horizontally supported by the side walls 16 and 18 in a straight parallel relation to traverse the chamber 12 at a location spaced above lower plate 24. These rods 38 are made from a suitable insulating material having electrical isolation properties, such as a silica material. A door interlock switch 40 is mounted along edge 22 of wall 18 for contact actuation by the door 20, such that, the switch 40 is OFF when door 20 is open and the switch 40 is ON when the door 20 is shut. The functional purpose of the door interlock switch 40 is explained in greater detail in connection with the description of the circuitry of FIG. 8.

As is common in conventional cooking ovens there is provided a lower electrical heating element 42 and an upper electrical heating element 44 for controlled heating of chamber air to cook the food. The lower heating element 42 is supported fixed on plate 24 and the upper heating element 44 is attached so as to be carried by the movable plate 30. These heating elements 42, and 44 are electrically connected in a usual manner to an ON-OFF power selector switch 46 conveniently located on a front panel 48 of oven 10. An ON-OFF EHT (enhanced heat transfer) selector switch 50 is located adjacent the power switch 46 and is operatable to selectively control main electrical power to operate electrical circuitry of the present system. A temperature control knob 52 is also on the panel 48 to permit the operator to adjustively select a desired oven temperature setting, as is normal. The upper and lower heating elements 42, 44 are thermostatically controlled by a temperature sensor element 54 exposed to oven air as is common in conventional electrical cooking ovens.

Figure 2:
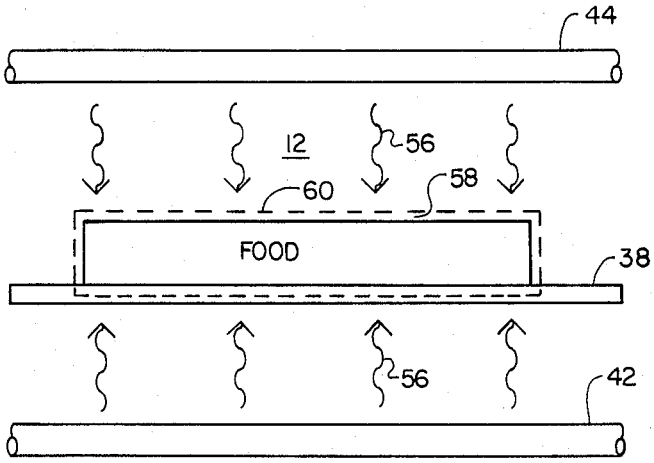
FIG. 2 is a front elevational view showing a partial section of the oven chamber when cooking food using conventional elements and showing an enlarged representation, in dashed lines, of an insulating film that forms about food being cooked.

FIG. 2 illustrates food resting on the insulator rods 38 in chamber 12 during a conventional cooking operation. Generally, heat wave arrows 56 illustrate thermal energy carried by the oven air from the heating elements 42, 44 in a direction extending towards the food for cooking. This widely used method of cooking is known to produce a thin film or layer 58 of thermal insulating stagnant air that adheringly forms at external food surfaces during a conventional cooking process. The film 58 is represented within dashed lines 60 and is exaggerated thick in the drawing for clarity sake. This film 58 is known to effectively impede the rate of heat and mass transfer between oven air and the food and to, thus, reduce the overall cooking efficiency of oven 10.

It is known in the art that by subjecting an external food surface to a corona current during the above described normal cooking process of FIG. 2, the rate of heat transfer may be improved and cooking times may be reduced. Effectively, the corona current operates to overcome the heat transfer restriction presented by the film 58. However, the use of the corona current in connection with cooking food is limited in the prior art and previous corona current generating apparatus fails to maximize the rate of heat and mass transfer throughout the cooking process. Accordingly, the present invention discloses a plurality of electrical fields utilized to maintain an optimum corona current density in the fields so as to maximize heat and mass transfer throughout the cooking process. The graphs of FIGS. 9, 10, 11A, 11B and 11C described below, clearly demonstrate a substantial cooking improvement with respect to reduced cooking times achieved by using the present apparatus enhancing heat and mass transfer.

Figure 3:
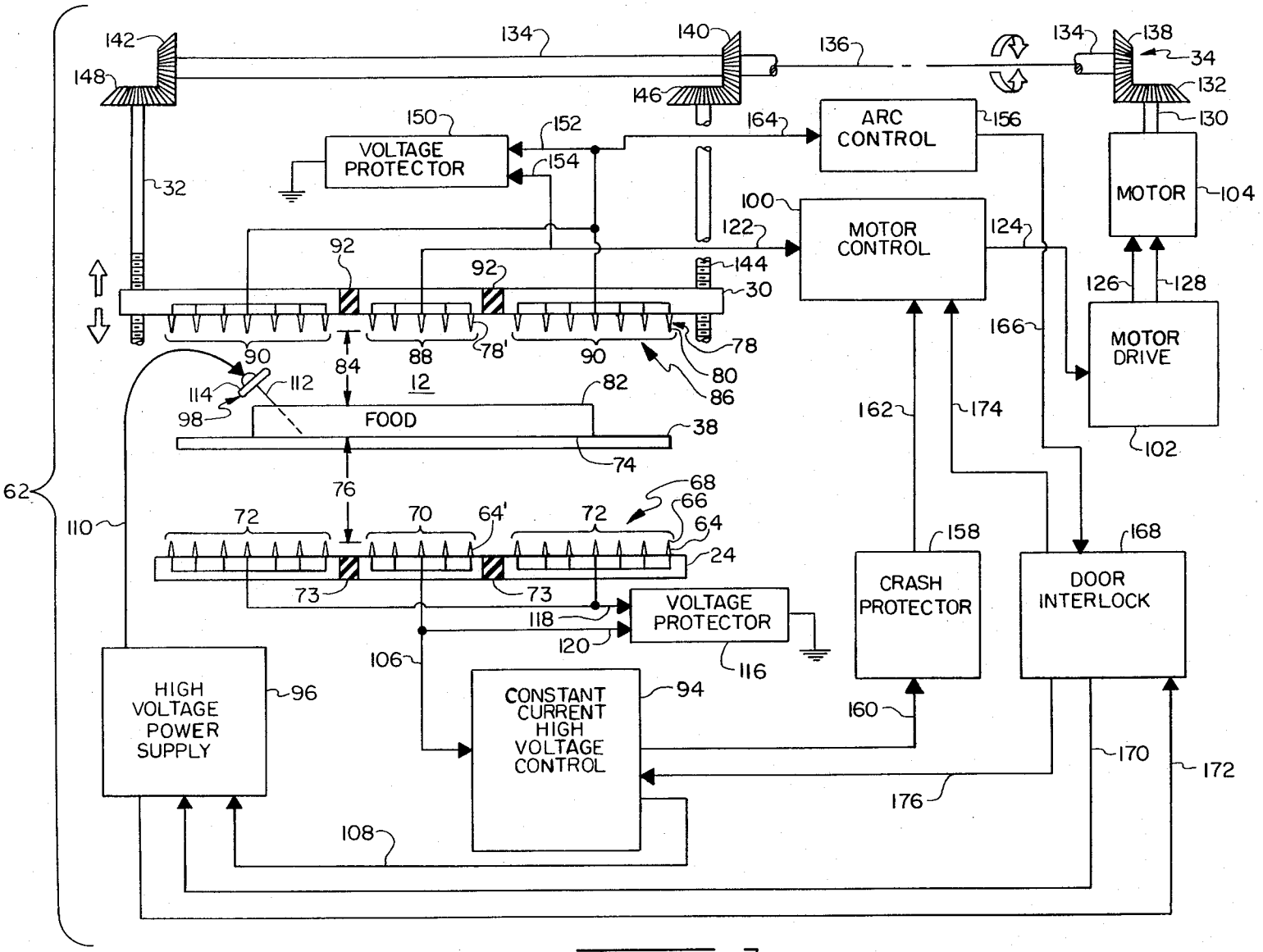
FIG. 3 is a schematic diagram of the present apparatus showing electrical circuitry components in block diagram form.

Generally, in FIG. 3 there is shown the present apparatus, denoted by reference numeral 62, illustrated in schematic form embodied in oven 10 of FIG. 1. Block diagrams, represent electrical components of the present apparatus 62. There is disclosed a first grid array of needle-like members 64 fixedly mounted upright on the lower plate 24. The needle members 64 are slightly tapered extending from lower plate 24 towards the food to terminate at a sharply pointed tip 66. Needle members 64 are made from an electrical conductive metallic material. Collectively, the lower array of needle members 64 on plate 24 form a first or fixed electrode 68. A central segment 70 of electrode 68 includes needles 64' (these needles having a prime designate symbol) electrically isolated from the needles 64 of an encircling dependent segment 72. A suitable electrical insulating material 73, i.e., an electrical insulating ceramic, is bonded to plate 24 so as to join the central segment 70 to the dependent segment 72 having electrical isolation therebetween. The needles 64' of the isolated segment 70 are electrically interconnected among themselves and the needles 64 of the dependent segment 72 are electrically interconnected among themselves. The fixed electrode 68 is spaced below the rods 38 in an aligned parallel orientation with respect to a bottom surface 74 of the food. The rods 38 are thin enough and are arranged so that they are periodically distributed out of vertical relationship to the needles 64 and 64'. The spaced gap between electrode 68 and food surface 74 defines a first electrical field 76 for supporting corona current density as described. It should be pointed out that an exact geometry, number and spacing relationship among all needles 64 and 64' need not be limited, provided optimum corona current density as set forth in this disclosure is attainable in the field 76.

Figure 4:
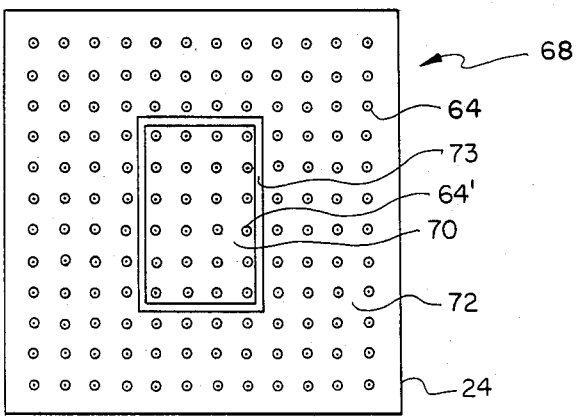
FIG. 4 is a top view showing an electrode configuration according to the preferred embodiment of the present invention.

Generally, one preferred arrangement of needles 64, 64' is shown in FIG. 4 wherein the needles 64, 64' are arranged in straight even rows and columns equally spaced apart. As can be seen in this view, the central isolated segment 70 is preferably rectangularally shaped, however, the segment 70 may be square or arranged in other suitable configurations beneath the food. It is to be further understood that the exact number of individual needles 64, 64' comprising each segment 70 and 72 of electrode 68 need not be limited provided the food is aligned above the isolated segment 70 to completely cover all needles 64'.

The present invention utilizes corona current measured in terms of corona current densities. Therefore, the area and the number of needles 64' and 78' comprising the isolated segments 70 and 88 needs to be known in order to establish the circuitry for monitoring the corona current density in the electrical fields 76 and 84. In the preferred embodiment the central isolated segments 70 and 80 are constructed alike and each contains twenty-four (24) needles 64' and 78' equally spaced apart about one-half inch.

Continuing in reference to FIG. 3, there is shown another grid array of needle-like members 78 attached to project downwardly from the movable plate 30. These needles are identically shaped and arranged on plate 30 like the needles 64 on lower plate 24. Metallic needle members 78 have a sharp-pointed tip 80 spaced above a second food surface 82 to define a second electrical field 84. Collectively, needles 78 and 78' on movable plate 30 form a second electrode 86 which is also constructed having a central isolated segment 88 comprising needles 78' (denoted by a prime) and a surrounding dependent segment 90 having needles 78. Electrical insulating material 92 is bonded along plate 30 to electrically isolate the central segment 88 from the dependent segment 90. The needles 78' of the central segment 88 are interconnected among themselves and the needles 78 of the dependent segment 90 are interconnected among themselves. Thus, the significant distinction between the two electrodes 68 and 86 resides in the fact that the lower electrode 68 is assembled to remain stationary with respect to the food and the upper electrode 86 may be moved vertically with respect to the food.

In accordance with an important aspect of the present invention, it has been discovered that by applying a constant or very nearly constant corona current density in each one of the respective electrical fields 76, 84, heat and mass transfer is enhanced. Moreover, enhanced heat and mass transfer has been found to most effectively occur when the fields 76 and 84 are continually regulated to constantly support a found optimum corona current density. Applicant has discovered that when the corona current density in electrical field 76 is maintained at 25 $\mu$A per inch$^2$ maximum heat and mass transfer is found to occur at food surface 74. Thus, 25 $\mu$A per inch$^2$ is considered an optimum corona current density rate for the lower fixed electrical field 76. Abbreviation $\mu$A is a common symbol representing a microampere equalling one-millionth of an ampere. This optimum corona current density rate in field 76 is noted to have an acceptable tolerance ranging between 15 $\mu$A per inch$^2$ and 35 $\mu$A per inch$^2$. Accordingly, a corona current density rate within the acceptable stated range for field 76 provides maximum or very nearly maximum heat and mass transfer at food surface 74. Additionally, it has been discovered that when the corona current density in the upper electrical field 84 is maintained at 15 $\mu$A per inch$^2$ maximum heat and mass transfer is found to occur at food surface 82. Thus, 15 $\mu$A per inch$^2$ is considered an optimum corona current density rate for the upper electrical field 84. Also, optimum corona current density in electrical field 84 is found to have an acceptable tolerance ranging between 5 $\mu$A per inch$^2$ and 25 $\mu$A per inch$^2$. A corona current density within the acceptable stated range for field 84 provides maximum or very nearly maximum heat and mass transfer at food surface 82. The effectiveness of applying the optimum current densities to the food during the cooking process is graphically demonstrated in connection with FIGS. 11A, 11B and 11C.

In order to most efficiently operate, electrical fields 76 and 84 need to be controlled so that they constantly support optimum or nearly optimum corona current density all during the cooking cycle and from one cycle to the next. Maintaining constant corona current density presents a problem because the electrical impedance in each electrical field 76, 84 is different and continually changing during the cooking process due to different temperatures, different moisture content about the food and different potential supplied to the food.

The above-stated problem is overcome through the cooperative functioning of the electrical block components shown in block diagram form in FIG. 3. Generally, three electrical component blocks including a Constant Current High Voltage Control 94, a High Voltage Power Supply 96 and probe 98 are associated with the fixed electrode 68 for maintaining constant optimum corona current density in the first field 76. The components including a Motor Control block 100, a Motor Drive 102, a motor 104 and the drive means 34 are associated with the movable electrode 86 for maintaining constant optimum corona current density in the field 84.

It should be pointed out that the circuitry of the present apparatus 62 is electrically set-up to operate the electrodes 68 and 86 at a low potential with respect to ground and relative to the food which is kept at an adjusted high potential. However, reverse potential relationship is recognized as being operable. The preferred disclosed potential relationship offers the advantage of permitting a relatively compact oven construction because the high potential food needs only to be electrically isolated from chamber walls 14, 16 and 18 to prevent current loss. In a reverse potential situation, high potential electrodes would need to be kept away from the walls 14, 16, 18, to prevent current loss and, thus would require a much larger chamber.

A broad overview of the circuitry of apparatus 62 will now be given in reference to the block diagram portion of FIG. 3. As seen in that Figure, the Constant Current High Voltage Control unit 94 is connected to the isolated segment 70 by a line 106 electrically coupled to needles 64' for carrying conducted current generating through the field 76. The Constant Current High Voltage Control, 94 is connected to the High Voltage Power Supply 96 by a line 108. An output line 110 from the High Voltage Power Supply 96 is electrically coupled to the needle probe 98 for conducting the positive high voltage supplied to the food. The food probe 98 has a needle-shaped end 112 supporting an insulating grip handle 114 so that the probe 98 may be insertably exchanged to the food before and after cooking.

Electrical components 94, 96 and probe 98 interoperate to control the corona current density in the electrical field 76 by continually adjusting the high potential supplies to the food in order to maintain constant optimum corona current density in that electrical field 76. To accomplish this, generally, the conducted corona current on line 106 from needles 64' is supplied to the Constant Current High Voltage Control 94. This block 94 operates to convert the conducted corona current to a negative output voltage signal appearing on line 108. This output voltage signal on line 108 is inversely related to the conducted corona current on line 106. That is to say, a relatively low positive conducted corona current on line 106, due to the field 76 supporting corona current density below optimum, is converted in block 94 to a proportionally raised negative voltage output signal appearing on line 108 and relatively high positive conducted corona current on line 106, due to the field 76 supporting corona current density above optimum, is converted to a proportionally lowered negative voltage output signal appearing on line 108. The negative output voltage signal on line 108 is fed to the High Voltage Power Supply 96 wherein it is utilized to proportionally adjust its voltage output on the line 110 to the food through the probe 98. The High Voltage Power Supply 96 operates to supply a positive high voltage to the food in response to receiving the negative voltage signal. The High Voltage Power Supply 96 is caused to lower its positive voltage output when the signal on line 108 is a low negative voltage and it is caused to raise its positive voltage output when the signal on line 108 is a high negative voltage. Thus, the high potential of the set food is continuously regulated to maintain optimum corona current density in the field 76 throughout the cooking process.

Also, in connection with the lower fixed electrode 68 there is shown a Voltage Protector block 116 electrically coupled to receive voltage from along a line 118 connected to the needles 64 of the dependent segment 72 and from along a line 120 tapped to receive the voltage on the line 106 from the isolated segment 70 of the electrode 68. The Voltage Protector block 104 is coupled to ground and operates to limit—keeps low—the voltage allowed to enter the Constant Current High Voltage Control 94. In this manner, conventional electrical elements in block 94 are protected against receiving any sudden high surging of voltage, such as may occur during arcing.

Turning now to the block diagrams associated with the upper movable electrode 86 in FIG. 3, there is shown the Motor Control circuit 100 connected to sense conducted corona current appearing on a line 122 from needles 78' of the isolated segment 88. Motor Control circuit 100 operates to generate a voltage output signal on a line 124 extending to Motor Drive block 102. The voltage output signal on line 124 from the Motor Control 100 is proportionally based on corona current conducted on line 122. A relatively high voltage output signal is caused to appear on line 124 when the conducted corona current on line 122 is caused by a high corona current in field 84 above optimum. Conversely, a relatively low voltage output signal is caused to appear on line 124 when the conducted corona current on line 122 is caused by a low corona current in field 84 below optimum. Two output lines 126 and 128 connect the Motor Drive block 102 to the Motor 104 having a rotatable shaft 130. A suitable Motor 104 is a bi-directional AC synchronous induction type commercially available from Bodine manufacturer identified as type 34T2. The Motor Drive block 102 operates to actively couple a selected one of the two lines 126 or 128 to ground in response to receipt of a high or a low voltage signal on line 124 from the Motor Control 112. Grounding of line 126 causes the motor shaft 130 to rotate in one direction and grounding of the line 128 causes the motor shaft 130 to rotate in its other direction. When the voltage signal on the line 124 is caused by optimum corona current conducted on line 122 neither of the lines 126 or 128 is grounded and there is no shaft 130 rotation. Rotating shaft 130 due to grounding of the line 126 causes the movable electrode 86 to move, through operation of the drive means 34, upwardly away from the food. Upward movement of electrode 86 is in response to corona current density in the electrical field 84 being above optimum. Raising electrode 86 above the food effectively increases the electrical impedance in the field 84 to thereby reduce the corona current density to food surface 82. Conversely, rotating shaft 130 due to grounding of line the 128 causes the movable electrode 86 to move downwardly. Downwardly motion of electrode 86 is in response to corona current density in electrical field 84 being below optimum. Moving the electrode 86 towards the food effectively reduces the impedance in the field 84 to thereby increase the corona current density to food surface 82. If the corona current density in the electrical field 84 is at optimum, the movable electrode 86 is caused to remain stationary.

Generally, the mechanical drive means for moving the upper electrode 86 towards and away from the food is denoted at 34. Drive means 34 includes a bevel gear 132 fixed to rotate with the motor shaft 130. An elongated shaft 134 is suitably supported for rotating movement about its axis 136 orientated in perpendicular relation to motor shaft 130. Three spaced apart bevel gears 138, 140 and 142 are fixed along the shaft 134. The first gear 138 is in meshing relation with the bevel gear 132 so that the elongated shaft 134 is caused to rotate in conjunction with rotating movement of the motor shaft 130. A vertical power drive screw 144 and the power drive screw 32 are thread coupled to power drive the movable electrode 86. The two drive screws 144, 32 each fixedly carry a bevel gear 146, 148, respectively. These bevel gears 146, 148 are in mesh with the gears 140, 142, respectively. Thus, it is shown that the movable electrode 86 is coupled to move vertically from the Motor 104 through the above-described mechanical drive means 34. The direction of vertical displacement (up or down) of the movable electrode 86 is dependent upon the direction motor shaft 130 is caused to rotate. It is to be understood that the disclosed mechanical drive means 34 is preferred, however, other mechanical elements, e.g., cables supported on pulleys, may be utilized to displace the electrode 86 through operation of the Motor 104. The above-described components 100, 102, Motor 104 and the mechanical drive means 34 interoperate to maintain constant corona current density in the electrical field 84 by adjustively displacing the movable electrode 86 towards and away from the food to continually seek optimum corona current density.

In connection with the upper movable electrode 86 there is provided a Voltage Protector block 150 electrically coupled to receive voltage from along a line 152 connected to needles 78 of the dependent segment 90 and from along a line 154 tapped from line 122 connected to needles 78' of the isolated segment 88 of electrode 86. The Voltage Protector block 150 is coupled to ground and operates to limit—keeps low—the voltage entering the Motor Control 100 and an Arc Control block 156 to protect these blocks 100, 156 against exposure to a high transient voltage surge, that may result from arcing.

In the event the corona current density in the electrical field 76 and 84 becomes extremely small or removed completely, such as occurs when the electrical power in the High Voltage Power Supply is cut-off, downwardly displacement of the movable electrode 86 must be stopped to prevent the electrode 86 from colliding with the food in seeking increased corona current. Accordingly, a Crash Protector 158 is coupled to receive a voltage signal appearing from along a line 160 coupled from the Constant Current High Voltage Control 94. An output line 162 extends from the Crash Protector 158 to the Motor Control 100. The Crash Protector 158 is actively operated with an excessively low corona current is conducted on line 106. This low input signal causes a high potential signal to appear on the line 160. The high potential signal on line 160 causes block 158 to generate a high negative output signal on the line 162 to the Motor Control 100. The high negative output signal on line 162 takes priority over any signal from amplifier 1B in the Motor Control 100 (FIG. 5) and causes a high potential signal to appear on line 124 which, in turn, is supplied to the Motor Drive 102 for causing the Motor 104 to retract upwardly the movable electrode 86. When the conducted corona current on line 106 returns to within the optimum range, the high potential output signal disappears from line 160 causing the high negative output signal to disappear from line 162 and allows normal operation of the Motor Control 100.

Figure 8:
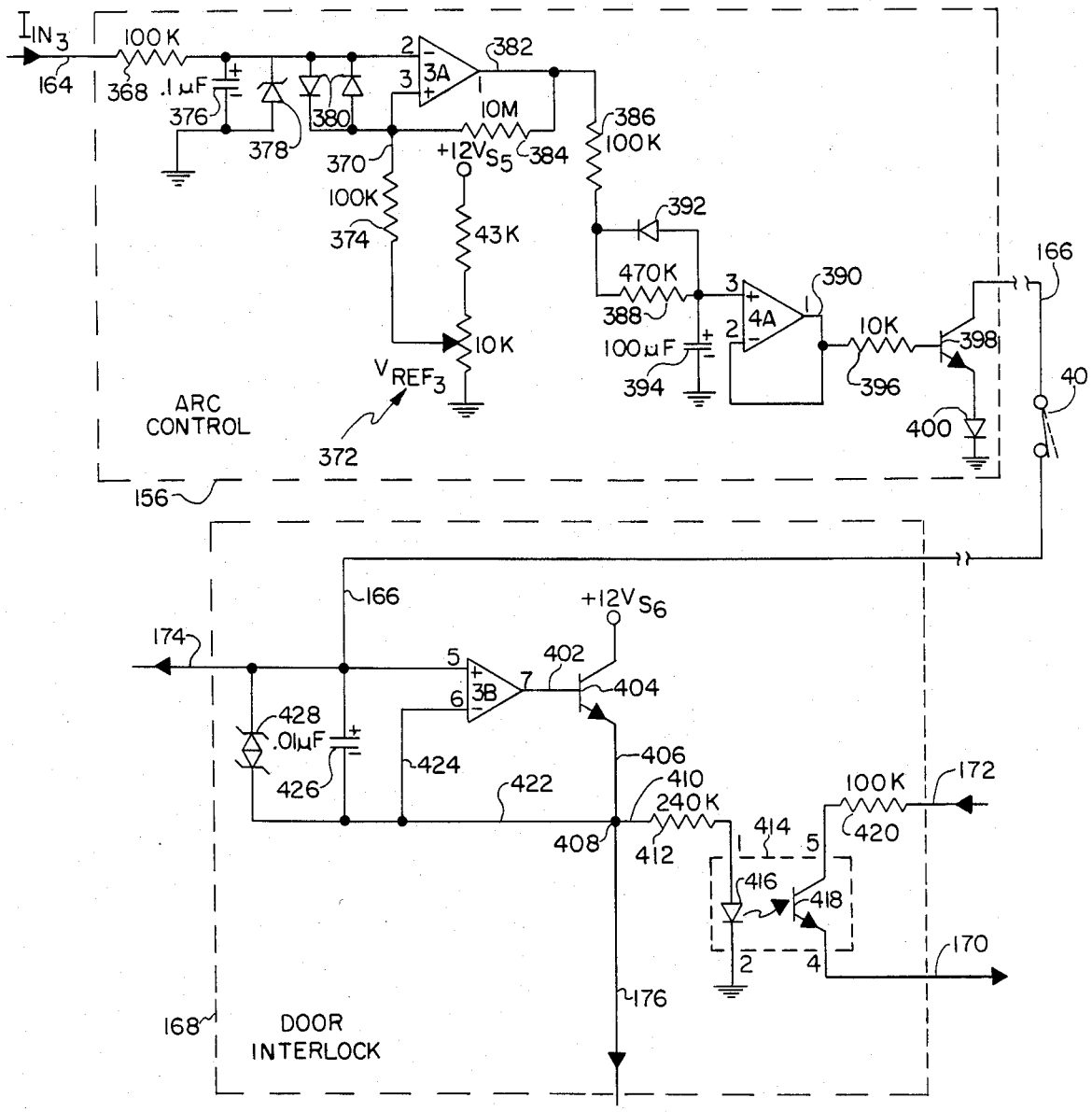
FIG. 8 is a detailed schematic showing electrical elements comprising two of the circuitry blocks of FIG. 4.

Another high voltage protective circuit is found in the Arc Control block 156. This block 156 has an input line 164 tapped from line 152 for carrying the corona current conducted from the dependent segment 90 of upper electrode 86. An output line 166 from the Arc Control 156 extends to a Door Interlock block 168. The door interlock switch 40 operable by door 20 is in series on line 166 intermediate Arc Control 156 and the Door Interlock block 168 as shown in FIG. 8. Arc Control 156 operates in response to excessively high conducted current on the line 164, such as may occur under an arcing condition at dependent segment 90. Normally, the output signal from the Arc Control 156 on line 166 permits normal operation of the present system. When the conducted current from line 152 to line 164 is excessively high due to arcing, the Arc Control 156 operates to generate a high output signal on the line 166 supplied to the Door Interlock 168 wherein it is utilized as described below.

The Door Interlock block 168 is electrically coupled to the High Voltage Power Supply 96 by lines 170 and 172. Normally, no current flows on these lines 170 and 172. A line 174 extends from the Door Interlock 168 to the Motor Control 100 and a line 176 extends to the Constant Current High Voltage Control 94. Generally, the Door Interlock 168 functions to interrupt operation of the High Voltage Power Supply 96 and to retract upwardly the movable electrode 86 when the door 20 is opened or when arcing occurs across field 84. Additionally, the Door Interlock 168 operates to limit the voltage output on line 108 from the Constant Current High Voltage Control 94 to regulate a slow turn on of the High Voltage Power Supply 96 when power is restored in the system and the door 20 is closed.

In normal operation, conducted current on line 164 produces no activating potential signal on line 166 from the Arc Control 156 to the Door Interlock 168 and there is no activating potential signal on lines 174 and 176, and no current flowing from line 174 to line 170. When the door 20 is opened or when a high potential signal is on line 166 from the Arc Control block 156, the Door Interlock 168 operates to generate a high potential signal on output lines 174 and 176, and continuity is provided to allow current flow between lines 172 and 170. The high potential output signal on line 176 causes the output 108 of the Constant Current High Voltage Control 94 to go negatively low to a limited maximum potential value for preventing an initial high voltage surge from occurring on line 108 when the forming of an arc is suppressed or when the door 20 is reclosed. The high potential output on line 174 causes the Motor Control 100 to generate a high positive output signal on line 124 utilized for retracting the movable electrode 86 upwardly. Current continuity between lines 172 and 170 causes the High Voltage Power Supply to interrupt its power output on line 110.

Having given a broad overview of the operation and function of the various circuitry block components of apparatus 62, a detailed description will now be given to describe the electrical elements in each individual block.

In each circuit block there is contained a composition of conventional electrical elements including electrical components that are commercially available and made to operate in a known conventional fashion. Preferred assigned values of individual electrical elements, e.g., kohms K of resistors and microfarads $\mu$F of capacitors, are shown in the drawing.

Figure 5:
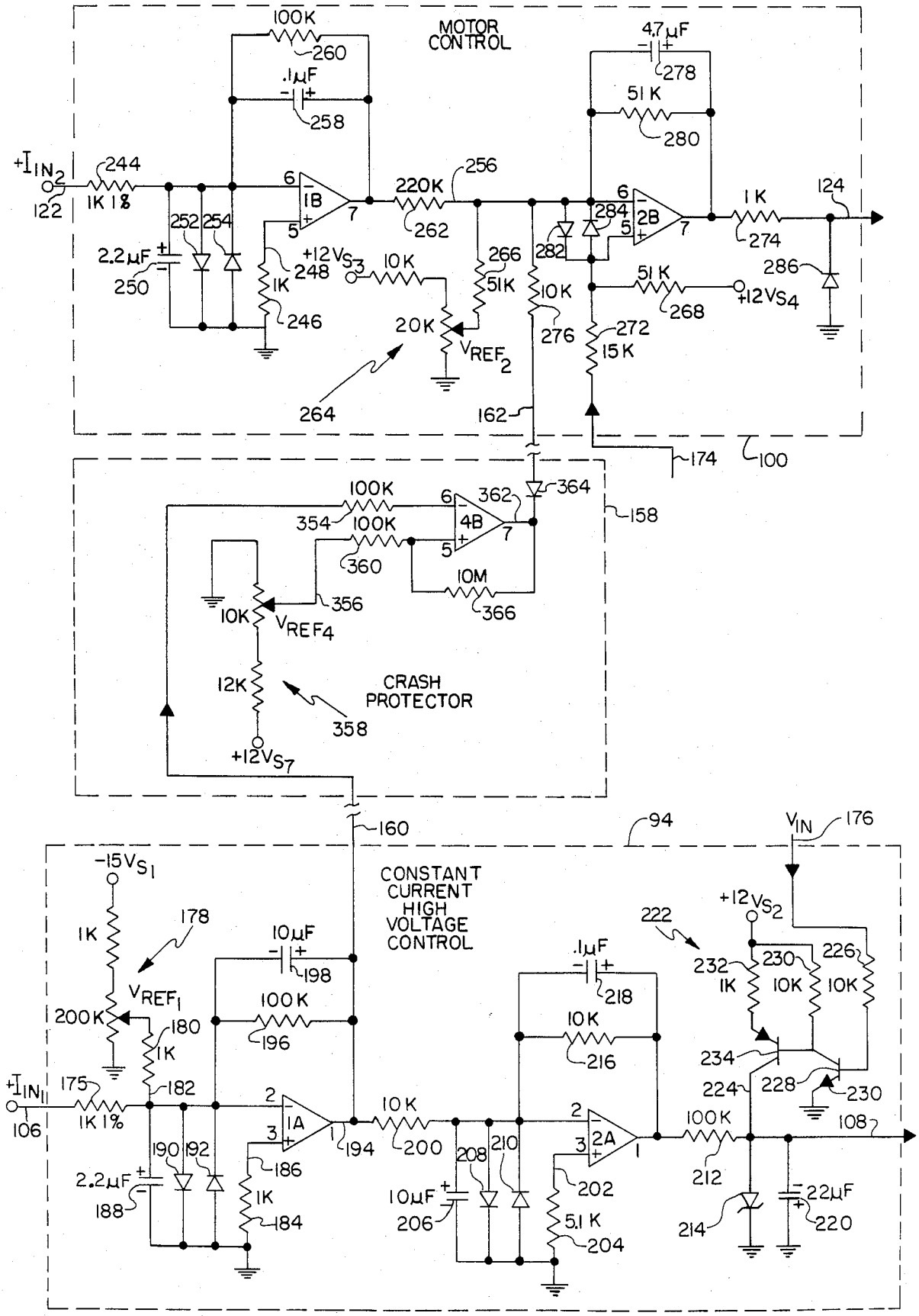
FIG. 5 is a detailed schematic showing electrical elements comprising three of the circuitry blocks of FIG. 4.

Beginning now with the description of the electrical elements comprising the Constant Current High Voltage Control block 94 shown in FIG. 5. The $+I_{IN1}$ signal sensed on line 106 is due to conducted corona current from the isolated segment 70 through electrical field 76. The conducted corona current, $+I_{IN1}$, is applied through a precision resistor 175 (1.0K) having a 1% accuracy. The conducted current on line 106 generates a positive voltage across resistor 175 which voltage is proportional to the corona current flowing between the isolated segment 70 and food surface 74. An adjustable potentiometer 178 has a negative 15 volt supply at $-15$ $V_{S1}$ and is setup to provide a negative bias reference potential $V_{REF1}$ across a fixed resistor 180 (1K) on a line 182 tapped to the line 106. The voltage from resistor 175 is summed with the negative bias voltage supplied by $V_{REF1}$ and the net voltage is supplied to a minus input terminal 2 of an operational amplifier 1A. The net voltage at terminal 2 is normally a net negative potential because the negative bias of $V_{REF1}$ is preset to be normally a higher potential value than the positive voltage across resistor 175. A positive input terminal 3 of operational amplifier 1A is served by a potential across a resistor 184 (1K) on a line 186. A capacitor 188 (2.2 $\mu$F) and spaced reversed diodes 190, 192 extend in parallel relationship connected between lines 106 and 186 and collectively function to protect amplifier 1A from being damaged by preventing any high transient voltage surge from entering amplifier 1A. The operational amplifier 1A is a conventional component preferably comprising one-half of a Low Power Dual Operational Amplifier, such as, one identified as LM 358 in a 1980 Linear Databook published by National Semiconductor Corporation of Santa Clara, Calif. An output terminal 1 of amplifier 1A is electrically coupled to a line 194. The line 160 is tapped from line 194 for transporting an output voltage signal from amplifier 1A to the Crash Protector 158 where it is utilized as described below. An operational control feedback circuit for amplifier 1A includes a resistor 196 (100K) and a capacitor 198 (10 $\mu$F) extending in parallel relation connecting line 160 to the line 106. The output voltage signal on line 194 is coupled through a resistor 200 (10K) and then supplied to a minus terminal 2 of another operational amplifier 2A. The operational amplifier 2A is like the amplifier 1A, in that it is one-half of another Low Power Dual Operational Amplifier LM 358 as identified above. A positive input terminal 3 of operational amplifier 2A is coupled to receive a potential signal from a line 202 supporting a series resistor 204 (5.1K). A capacitor 206 (22 $\mu$F) and spaced reversed diodes 208, 210 are arranged in parallel and are coupled between lines 194 and 202 for voltage protection of amplifier 2A. Amplifier 2A functions as an inverter for reversing the potential polarity of the signal received from along line 194. An output terminal 1 of amplifier 2A generates the inverted voltage signal onto the output line 108 through a coupling resistor 212 (100K) to the High Voltage Power Supply 96. A Zener diode 214 is tapped from line 108 and has a 6.8 voltage breakdown limit. Zener diode 214 operates to clamp the voltage signal on line 108. An operational control feedback circuit including a resistor 216 (10K) and a capacitor 218 (0.1 $\mu$F) are arranged in parallel connecting lines 108 and 194 across amplifier 2A. A capacitor 220 (22 $\mu$F) is tapped from line 108 to function as a time constant control for limiting any sudden appearance of a voltage signal on line 108 to gradually supply increasing voltage to the High Voltage Power Supply 96. The line 176 is from the Door Interlock block 168 and through a voltage clamping circuit 222 is ultimately connected to line 108 by a line 224. The voltage clamping circuit 222 include a resistor 226 (10K) on line 176 coupled to the base of a transistor 228 whose emitter 230 goes to ground. A $+12$ volt source at $+12$ $V_{S2}$ supplies a load through a resistor 230 (10K) electrically coupled to the collector side of the transistor 228. The $+12$ $V_{S2}$ potential load is also coupled through a resistor 232 (1.0K) to a transistor 234. When a potential $V_{IN}$ signal appears on line 176 from the Door Interlock 168, the clamping circuit 222 operates to provide a positive potential signal summed to the negative voltage already on line 108. The net result of this causes the output signal on line 108 to be clamped near zero volts to limit the voltage signal supplied to the High Voltage Power Supply 96. When the potential $V_{IN}$ signal disappears from line 176, such as, occurs when the door 20 is closed shut, the charged capacitor 220, limited by the Zener diode 214, controls the negative turn on voltage on line 108 supplied to the High Voltage Power Supply 96.

In operation of the Constant Current High Voltage Control 94, conducted corona current $+I_{IN1}$ on line 106 is applied across resistor 175 to generate a positive voltage signal proportionally representative of the corona current flowing in the electrical field 76 between the isolated segment 70 and the food surface 74. This positive voltage signal from resistor 175 is summed with the negative bias reference voltage supplied by $V_{REF1}$ to provide a net negative voltage signal at minus terminal 2 of amplifier 1A. The output signal generating from output terminal 1 of amplifier 1A on line 194 is a positive voltage signal whose value is proportional to the net negative voltage signal received at input terminal 2. The positive voltage signal on line 194 is applied through resistor 200 and is supplied to the minus terminal 2 of amplifier 2A. Operation of amplifier 2A causes output terminal 1 thereof to generate a negative voltage signal on line 108 whose value is proportional to the positive input received at minus terminal 2 of amplifier 2A.

In order for enhanced heat and mass transfer to occur at food surface 74, the corona current at the lower fixed electrode 68 needs to be regulated so that the corona current density in electrical field 76 is maintained at a constant current flow rate found to maximize heat and mass transfer. Applicant has discovered that a controlled field 76 supporting an optimum current density of 25 $\mu$A per inch$^2$ and having an acceptable tolerance deviation from optimum ranging from 15 $\mu$A per inch$^2$ to 35 $\mu$A per inch$^2$ provides maximum heat and mass transfer irrespective to oven air temperature and from one cooking cycle to the next.

In the preferred embodiment, the isolated segment 70 has a known area supporting 24 individual needles 64' equally spaced about 0.5 inch apart. In order to obtain the optimum corona current density (25 $\mu A/in^2$), each needle 64' generates approximately 6.25 $\mu A$. When optimum corona current is in field 76, the conducted current $+I_{IN1}$ on line 106 is approximately 150 $\mu A$ and the resulting negative voltage signal on line 108 is in a range between −0.5 volt to −4 volts for operative control of the High Voltage Power Supply 96 to adjust its voltage output on line 110. If, for example, the corona current density at isolated segment 70 goes above optimum (25 $\mu A/in^2$), the conducted current on line 106 increases above 150 $\mu A$ and positive voltage from resistor 175 is summed to the $V_{REF1}$ signal causing the net negative voltage signal to decrease at the minus terminal 2 of amplifier 1A. The output terminal 1 of amplifier 1A is then caused to generate a reduced positive voltage on line 194 supplied to the minus terminal 2 of amplifier 2A. The output on line 108 from amplifier 2A is decreased to a lower negative voltage value for causing the High Voltage Power Supply 96 to reduce its voltage output on line 110 supplied to the food and thereby reduce the corona current in field 76 towards optimum density. The reverse operation occurs when the corona current goes below optimum. This described electrical system continues to operate in this fashion to stabilize current flow in field 76 throughout the cooking process. The signal on line 108 may vary between any negative voltage between −0.5 volts and −4 volt necessary to cause the High Voltage Power Supply 96 to regulate its voltage output on line 110 for maintaining optimum corona current in the field 76.

Regarding the High Voltage Power Supply block 96 of FIG. 3, this component is a constant current output DC (direct current) positive high voltage supply whose output current is both adjustable and regulated. The design of the unit may be made in any suitable fashion by one skilled in the art provided the following electrical requirements are met.

| | | |
|---|---|---|
| A | INPUT | 105 to 135 VAC (Voltage alternating current) / 60 HZ (Hertz) |
| B | ADJUSTABLE OUTPUT CURRENT RANGE | 0.5 MA (milliampers) to 4.0 MA, via a DC Voltage, 0.5 volts to to 4.0 volts with a linear relationship. Input impedance of this terminal . . . to be greater than 100 K (kilohm). |
| C | OUTPUT CURRENT | +20% of adjustment setting (includes output current regulation), i.e., with input voltage of 2 volts, output current = 2 MA + 20% with all loads. |
| D | MAX OUTPUT POWER | 100 Watts at 4 MA Note: 35 KV (kilovolts) is max. allowable voltage. |
| E | NORMAL OUTPUT LOAD IMPEDANCE RANGE | 2 Megohms to 200 megohms (resistive) |
| F | NORMAL OUTPUT LOAD CAPACITANCE | 400 PF (Picofarad) |
| G | OUTPUT CURRENT RIPPLE | Less than 20% of DC value |
| H | OUTPUT LOAD FOR SETTING OUTPUT CURRENT | 5 Megohms for 4 MA at 20 KV 5 Megohms for 0.5 MA at 25 KV |

Note: Output current must be adjustable and maintain regulation down to an output voltage of 2 KV, into the normal resistive load range, and load capacity.

-continued

| | | |
|---|---|---|
| I | OUTPUT CURRENT SETTLING RESPONSE | 1 Second max. to within 5% of its final value. |
| J | BLEED-OFF | Must bleed-off to within 5% of initial value in less than 2 seconds. |
| K | OSCILLATOR FREQUENCY | Greater than 20 KHZ (kilohertz) |
| L | CONVECTION COOLING | 30 CFM to be provided for output heat sink. |

The High Voltage Power Supply 96 is equipped with conventional electrical elements suitably arranged to operate, such that, its positive voltage output on line 110 to the probe 98 is regulated in proportion to the received signal from along line 108 generating from the Constant Current High Voltage Control 94. A relatively high negative input from along line 108 regulating a proportionally higher positive voltage output on line 110; a relatively low negative input from along line 108 regulating a proportionally lower positive voltage output on line 110.

Figure 6:
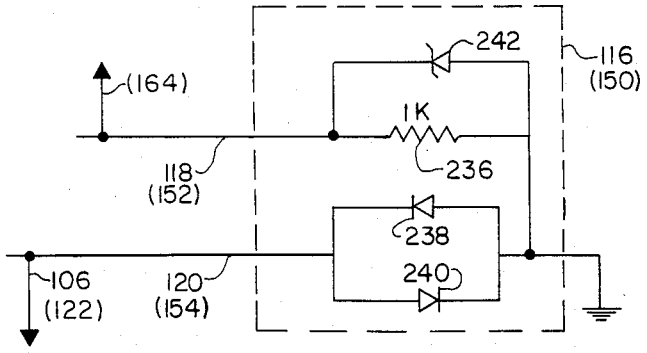
FIG. 6 is a detailed schematic showing electrical elements comprising the two Voltage Protector circuitry blocks of FIG. 4.

Referring now to FIG. 6, there is shown conventional electrical elements comprising the Voltage Protector block 116. The line 118 carries current conducted from the dependent segment 72 of electrode 68. A resistor 236 (1K) is in series on line 118. The line 106 carries current conducted from the isolated segment 70 of electrode 68 and two diodes 238, 240 are arranged in reversed parallel relation so that voltage on line 106 is clamped to a low voltage approximating 0.6 volts. A Zener diode 242 is coupled across resistor 236 for clamping the voltage at the dependent segment 72 in the Voltage Protector 116. The electrical elements comprising block 116 are arranged to set a low voltage limit that the Constant Current High Voltage Control 94 may receive in order to prevent it from exposure to any sudden high voltage surge, such as may occur during arcing.

Turning now to a detailed description of electrical components for controlling vertical displacement of the movable electrode 86, there is shown in FIG. 5 conventional electrical elements comprising Motor Control block 100. Conducted corona current on line 122 $+I_{IN2}$ from the isolated segment 88 of electrode 86 is applied to a precision resistor 244 (1.0K) having a 1% accuracy to precisely define the voltage of the $+I_{IN2}$ signal. The voltage from resistor 244 is proportionally representative to the corona current flowing in the electrical field 84 between the isolated segment 88 and the food surface 82. This voltage signal on line 122 is normally positive and needs to be amplified to a proportionally higher voltage value in order to be operationally utilized by ensuing circuitry. To accomplish this the voltage signal from resistor 244 on line 122 is fed to an operational amplifier 1B at a minus input terminal 6. Amplifier 1B forms the other half of the Low Power Dual Operational Amplifier LM 358 mentioned in connection with amplifier 1A in the Constant Current High Voltage Control block 94. Generally, amplifier 1B operates to produce a voltage gain at output terminal 7 of approximately 100 times over the voltage signal received at terminal 6. A second input terminal 5 of Amplifier 1B is served by a resistor 246 (1K) in series on a line 248. To protect the operational amplifier 1B against receiving any damaging high transient voltage, there is provided a capacitor 250 (2.2 $\mu F$) and two diodes 252, 254 connected in reversed parallel between the lines 122 and 248. The voltage multiple gain from operation of amplifier 1B is generated from the output terminal 7 onto a line 256. A capacitor 258 (0.1 μF) and a resistor 260 (100K) are connected in parallel between lines 256 and 122 to provide operational feedback for amplifier 1B operation. From the output terminal 7, the signal from amplifier 1B is applied through a resistor 262 (220K) in series on line 256. An adjustable potentiometer 264 has a +12 volt source at +12 $V_{VS3}$ to provide a preset positive offset bias reference potential $V_{REF2}$ across a resistor 266 tapped to the line 256. The offset reference potential $V_{REF2}$ is summed with the voltage from output terminal 7 of the amplifier 1B to provide a net offset potential fed to a minus terminal 6 of another operational amplifier 2B. Additionally, another (normally) fixed offset voltage signal is differently applied at the positive input terminal 5 of amplifier 2B, which offset signal is provided by a positive 12 volt source at +12 $V_{VS4}$ and applied to resistors 268 (51K) and 272 (15K). Amplifier 2B forms the other half of the Low Power Dual Operational Amplifier LM 358 mentioned in connection with the amplifier 2A in the Constant Current High Voltage Control 94. Operational amplifier 2B has an output terminal 7 for emitting a positive output signal applied to a resistor 274 (1K) on the line 124 extending to Motor Drive 102. The positive output signal generating from amplifier 2B has a proportionally inverted relation to the net negative offset potential received at minus terminal 6.

In operation of the Motor Control 100, conducted current $+I_{IN2}$ applied through resistor 244, generates a positive voltage signal on line 122 proportional to the corona current flowing in the electrical field 84 between the isolated segment 88 and the food surface 82. This positive voltage on line 122 enters amplifier 1B at minus terminal 6. As a result, the output potential signal generating from output terminal 7 of amplifier 1B onto line 256 is a proportionally increased negative voltage signal. The negative voltage signal on line 256, across resistor 262, is summed with the positive bias reference voltage supplied by $V_{REF2}$ to provide a net offset negative voltage at minus terminal 6 of amplifier 2B. This net negative voltage is further offset by the positive differential voltage applied at positive terminal 5 of amplifier 2B, so that, if $V_{REF2}$ is properly adjusted according to when the desired corona current (90 μA) is being conducted on line 122, the output terminal 7 of amplifier 2B will be generating a positive voltage approximating 6 volts for input $V_{IN2}$ to the Motor Drive 102. Thus, operation of amplifier 2B generates a positive voltage signal on line 124 whose value is inversely proportional to the received offset negative voltage.

A capacitor 278 (4.7 μF) and a resistor 280 (51K) are connected in parallel between lines 256 and line 124 to provide an operational feedback signal to amplifier 2B, as is common. Also in connection with amplifier 2B, there are provided two diodes 282 and 284 arranged in reversed parallel relation across input lines 256 and 174 for high voltage protection of amplifier 2B. A ground diode 286 is coupled to line 124.

In order for enhanced heat and mass transfer to occur at food surface 82, the corona current at electrode 86 needs to be adjusted so that the corona current density in electrical field 84 is maintained at a current flow rate found to maximize heat and mass transfer. Applicant has discovered that a controlled field 84 held at an optimum current density of 15 μA per inch$^2$ and having an acceptable tolerance deviation from optimum ranging from 5 μA per inch$^2$ to 25 μA per inch$^2$ provides maximum heat and mass transfer irrespective to oven air temperature and from one cooking cycle to the next.

In the preferred embodiment, the isolated segment 88 has an area supporting 24 needles 78′ equally spaced about 0.5 inch apart. In order to obtain the optimum corona current density (15 μA/in$^2$), it is desired that each needle 78′ generates approximately 3.75 μA. Therefore the conducted corona current $+I_{IN2}$ on line 122 is about 90 μA and the resultant voltage $V_{IN2}$ appearing on line 124 due to operation of the electrical components in the Motor Control block 100 is about 6 volts supplied to the Motor Drive block 102. If the conducted corona current $+I_{IN2}$ is above 90 μA on line 122, the output voltage generating from amplifier 1B on line 256 increases negatively which, when summed with the positive offset bias reference potential $V_{REF2}$ and the differential reference voltage from $V_{S4}$ causes the amplifier 2B to generate a proportionally increased positive voltage on line 124 above 6 volts. Conversely, if the conducted corona current $+I_{IN2}$ is below 90 μA on line 122, the output voltage generating from amplifier 1B on line 256 decreases negatively and the resultant positive voltage signal on line 124 goes below 6 volts.

Figure 7:
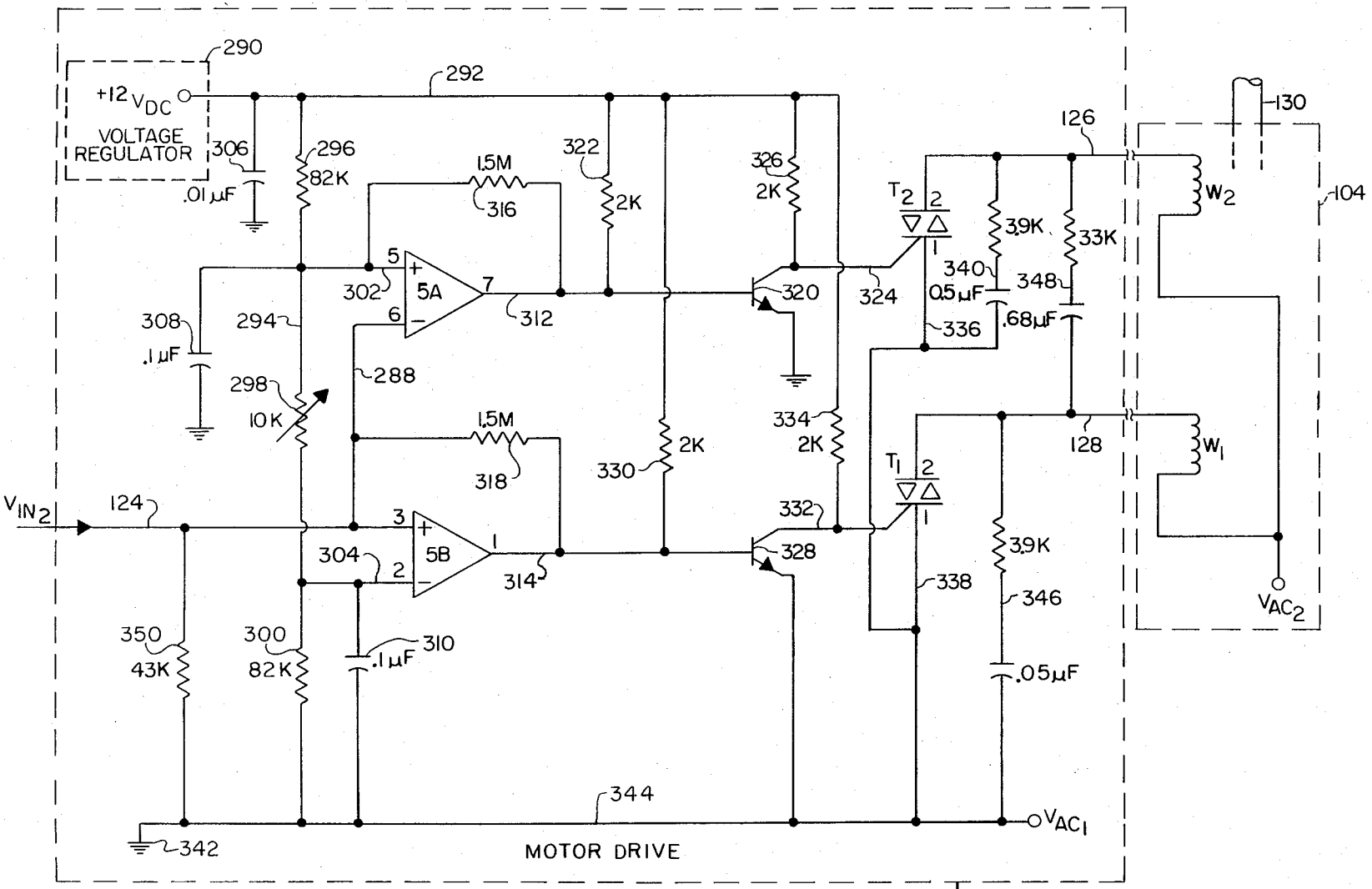
FIG. 7 is a detailed schematic showing electrical elements comprising the Motor Drive circuitry block of FIG. 4.

In FIG. 7, electrical elements comprising the Motor Drive unit 102 are shown in schematic form. Basically, the Motor Drive 102 includes a conventional Low Power Low Offset Voltage Dual Comparator component comprising a pair of high precision comparators 5A and 5B. A suitable electrical component containing the two comparators 5A and 5B is identified by the number LM 393 in the 1980 Linear Databook published by National Semiconductor Corporation of Santa Clara, Calif. Comparator 5B has a positive input terminal 3 coupled to receive the $V_{IN2}$ voltage signal from the Motor Control 100 on line 124. Simultaneously, the $V_{IN2}$ voltage signal is supplied to a negative terminal 6 of the other comparator 5A via a line 288 tapped from the input line 124. A negative input terminal 2 and a positive input terminal 5 of comparators 5B and 5A, respectively, are individually powered to operate from a single power supply comprising a suitably known DC linear voltage regulator 290 of the type having a +12 volts +12 $V_{DC}$ supply. A line 292 extending from regulator 290 carries the +12 volt supply to a line 294 having three series resistors 296 (82K), 298 (10K) and 300 (82K). Resistors 296 and 300 are fixed resistors and the intermediate resistor 298 is a variable resistor adjusted to provide a preset dead band voltage having a small value ranging between resistors 296 and 300, so that the reference voltage for amplifier 5A is higher than the reference voltage for amplifier 5B. A line 302 is tapped from line 294 for transporting the higher reference voltage to the positive terminal 5 of comparator 5A. Another line 304 is tapped from line 294 for carrying the lower reference voltage to the negative terminal 2 of comparator 5B. The reference voltage signal on lines 302 and 304 sever to operate comparators 5A and 5B, respectively, in response to the comparators 5A, 5B receiving the $V_{IN2}$ voltage signal from the Motor Control 100. A first DC filter capacitor 306 (0.01 μF) is tapped from line 292 and coupled to ground for control of the +12 V potential from the voltage regulator 290. A second filter capacitor 308 (0.1 μF) is tapped from lines 294, and a third filter capacitor 310 (0.1 μF) is tapped from line 304 for control of the reference voltages supplied to the comparators 5A and 5B, respectively. An output terminal 7 of comparator 5A, is electrically coupled to an output line 312. An output terminal 1 of comparator 5B is electrically coupled to an output line 314. An operational feedback resistor 316 (1.5M M denoting megohm) connects line 312 to line 302 for operatively controlling the comparator 5A. Another operational feedback resistor 318 (1.5M) connects line 314 to line 288 operatively controlling the comparator 5B. A first transistor 320 has its base coupled to receive a signal from along the line 312. A resistor 322 (2K) is connected from line 292 to line 312 to provide a pull-up potential on line 312 and to hold transistor 320 ON when the $V_{IN2}$ voltage signal on line 124 is less than the reference voltage on line 302. The emitter side of transistor 320 is coupled to ground and the collector side of transistor 320 is coupled to a line 324 extending to control switching operation of a conventionally known AC operating powered triac $T_2$. A pull-up resistor 326 (2K) is connected from line 292 to the line 324 to supply the necessary potential to control operation of the triac $T_2$. A second transistor 328 has its base coupled to receive a signal from along the line 314. A resistor 330 (2K) is connected from line 292 to the line 314 to provide a pull-up potential on line 314 and to hold transistor 328 ON when the $V_{IN2}$ voltage signal on line 124 is greater than the reference voltage on line 304. The emitter side of transistor 328 is coupled to ground and the collector side of transistor 328 is connected to an output line 332 extending to control switching operation of another conventionally known AC operating power triac $T_1$. A pull-up resistor 334 (2K) is connected from line 292 to line 332 to supply the necessary potential to control operation of the triac $T_1$. Triacs $T_2$ and $T_1$ are connected to receive a remote AC common power source at $V_{AC1}$ appearing on a line 336 to terminal 1 of triac $T_2$ and on a line 338 to terminal 1 of triac $T_1$. The line 126 is electrically coupled to terminal 2 of triac $T_2$ and is coupled to the Motor 104. The line 128 is electrically coupled to terminal 2 of triac $T_1$ and is electrically coupled to the Motor 104. A first resistor-capacitor series combination 340 is connected between line 336 and line 126, across triac $T_2$, and is coupled to ground at 342 and via a line 344. A second resistor-capacitor series combination 346 is connected between line 344 and line 128, across triac $T_1$ and is coupled to ground 342. The two resistor-capacitor circuits 340 and 346 function as snubbers in that they serve to prevent any peak transient voltage in the system from accidently turning the triacs $T_2$ and $T_1$ ON. A third resistor-capacitor series combination 348 is connected between motor lines 126 and 128 and function to control operation of the Motor 104 as discussed below. Remaining electrical elements in the Motor Drive 118 include a resistor 350 (43K) tapped from line 124 to provide a reference to ground 342 for the $V_{IN2}$ voltage signal.

In FIG. 7, the above-mentioned AC synchronous Motor is generally shown equipped with a first coil winding $W_2$ and a second winding $W_1$. Windings $W_2$ and $W_1$ are interconnected to receive power from a single remote AC power source denoted at $V_{AC2}$. The winding $W_2$ is connected to the line 126 and through triac $T_2$ of the Motor Drive 102 is switchably coupled to the ground 342. The other winding $W_1$ is connected to the line 128 and through triac $T_1$ of the Motor Drive 102 is switchably coupled to the ground 342. When the winding $W_2$ is grounded through triac $T_2$, the motor shaft 130 is caused to rotate in a direction that powers the drive means 34 (FIG. 3) for causing the electrode 86 to move upwardly away from the food. Conversely, the electrode 86 is caused to move downwardly towards the foot when the winding $W_1$ is grounded through the triac $T_1$. When neither line 126 or 128 is grounded, the shaft 130 remains stationary. The resistor-capacitor circuit 348 of Motor Drive 102 functions to shift the AC phase of motor winding $W_1$, with respect to motor winding $W_2$, to be leading or lagging for establishing motor rotational direction.

In operation of the Motor Drive 102 and Motor 104, it will be recalled that, the $V_{IN2}$ voltage signal appearing on line 124 from the Motor Control 100 is approximately 6 volts when the conducted current $+I_{IN2}$ on line 122 is at 90 $\mu$A. The +6 volts $V_{IN2}$ signal is simultaneously applied to the minus terminal 6 of comparator 5A from along line 288 and the plus terminal 3 of comparator 5B. The operating reference voltage on the line 302 is established to be about 6.1 volts. The operating reference voltage on the line 304 is established to be about 5.9 volts.

The $V_{IN2}$ voltage is compared to the operating reference voltage supplied to each comparator 5A and 5B. When the +6 volt $V_{IN2}$ voltage signal is applied to both comparators 5A and 5B, their outputs generating on lines 312 and 314, respectively, cause their related transistors 320 and 328 to be simultaneously switched to ON which, in turn, causes the associated triacs $T_2$ and $T_1$ to be switched to OFF. Neither line 126 nor line 128 is coupled to ground 342 when both triacs $T_2$ and $T_1$ are OFF causing the motor shaft 130 to remain stationary. Thus, the 6 volt $V_{IN2}$ voltage signal on line 124 falls within a "dead band" reference voltage between the two operating reference voltages (6.1 volts on line 302 to comparator 5A and 5.9 volts on line 304 to comparator 5B) and the remaining circuitry is effectively in an equilibrium condition. When the corona current density is above optimum in electrical field 84, the $V_{IN2}$ voltage signal appearing on line 124 from the Motor Control 100 goes above the 6.1 volt threshold set to the comparator 5A. The output voltage generating from terminal 7 from comparator 5A on line 312 is increased negatively for causing the transistor 320 to be switched to OFF which, in turn, switches the triac $T_2$ ON. When the triac $T_2$ is ON, current on line 126 is allowed to flow therethrough and the line 126 is coupled to ground 342. Grounding of line 126 directly energizes the winding $W_2$ and indirectly energizes winding $W_1$ interposing phase shifting circuit 348 to cause current through the winding $W_1$ to lead the current through winding $W_2$ and the motor shaft 130 is caused to rotate in the direction for moving the electrode 86 upwardly away from the food. Simultaneously, the relatively high $V_{IN2}$ voltage signal is applied to comparator 5B and its output causes its related transistor 328 to remain ON, which, in turn holds triac $T_1$ OFF. Conversely, when the corona current density is below optimum in electrical field 84, the $V_{IN2}$ voltage signal appearing on line 124 from the Motor Control 100 goes below the 5.9 volt threshold set to the comparator 5B. The output voltage generating from terminal 1 from comparator 5B on line 314 is increased negatively for causing the transistor 328 to be switched to OFF which, in turn, switches the triac $T_1$ ON. When the triac $T_1$ is ON, current on line 128 is allowed to flow therethrough and the line 128 is coupled to ground 342. Grounding of line 128 directly energizes the winding $W_1$ and indirectly energizes winding $W_2$ interposing phase shifting circuit 348 to cause current through the winding $W_2$ to lead the current through winding $W_1$ and the motor shaft 130 is caused to rotate in the opposite direction for moving the electrode 86 downwardly towards the food. Simultaneously, the relatively low $V_{IN2}$ voltage signal is applied to comparator 5A and its output causes its related transistor 320 to remain ON and triac $T_2$ to remain OFF.

From the above description of the Motor Control 100 and Motor Drive 102, it is understood that the movable electrode 86 is controlled to move upwardly and downwardly according to the corona current density in field 84 in relation to optimum. Effectively, through automatic adjustment of the movable electrode 86, the electrical impedance in the electrical field 84 is changed to support optimum corona current density. Thus, the electrode 86 is moved to continually seek and maintain optimum corona current density in the electrical field 84.

Additionally in connection with the operation of the Motor Drive 102, the previously described (normally) fixed offset potential differentially applied at the positive terminal 5 of amplifier 2B is a switchable offset potential source from $+12\ V_{S4}$ supplied to input terminal 5 through a voltage divider circuit comprising resistors 268 and 272 coupled to line 174. The line 174 provides a priority potential control for overriding the output signal from amplifier 1B on line 256 to amplifier 2B when a high potential signal occurs on line 174 when its conduction to ground is interrupted as described in connection with the Door Interlock 168. The high priority potential from line 174 through amplifier 2B forces the voltage on line 124 to rise to a value wherely Motor 104 is caused to move electrode 86 upwardly away from the food.

The line 162 extending from the Crash Protector block 158 is tapped to the line 256 to provide a second priority control signal for overriding signal appearing from amplifier 1B on line 256. The second priority control signal is a negative offset potential signal across resistor 276 on line 162 to line 256 and is caused to occur whenever an excessively low current $+I_{IN1}$ is conducted on line 106 of the Constant Current High Voltage Control 94. Generating the second priority control signal on line 162 is described in connection with the description of Crash Protector 158. Generally, the second priority signal is applied to the minus terminal 6 of amplifier 2B for forcing the output potential on line 124 to rise for causing Motor 104 to move electrode 86 upwardly away from the food.

Conventional electrical elements comprising the Voltage Protector block 150 associated with the movable electrode 86 are shown in FIG. 6 and include like electrical elements that operate in the same fashion as the electrical elements comprising the lower Voltage Protector block 116. In FIG. 6, reference numerials 152 and 154 coupled to the dependent and isolated segments 90 and 88, respectively are shown in parenthesis and correspond to the lower input lines 118 and 120, respectively. The electrical elements of Voltage Protector block 150 (also denoted within parenthesis in FIG. 6) operate to limit high transient voltage on line 122 to the Motor Control 100 and on line 164 to Arc Control 156 for voltage protection of the electrical components in unit 100 and 156.

Turning now to the description of the electrical elements comprising the Crash Protector unit 158 shown in FIG. 5. This circuitry 158 is electrically connected to the Constant Current High Voltage Control 94 by the line 160 and to the Motor Control block 100, by the line 162. Generally, the Crash Protector 158 operates to retract the movable electrode 86 when corona current in the electrical field 76 becomes extremely low—far below optimum—such as occurs when the electrical power in the High Voltage Power Supply 96 is switched to OFF. In this regard the electrode 86 is prevented from seeking increased corona current and subsequently contacting the food when high voltage is removed.

To accomplish this, line 160 is tapped from line 194 to receive the positive output signal generating from amplifier 1A in the Constant Current High Voltage Control block 94. Line 160 supports a series resistor 354 (100K) to supply a potential signal to a minus input terminal 6 of an operational amplifier 4B. This amplifier 4B is like the amplifier 1B of the Motor Control 100 in that it also forms one-half of another conventional Low Power Dual Operational Amplifier LM 358 as previously mentioned. A plus input terminal 5 of amplifer 4B is electrically coupled to receive a reference potential supplied by $V_{REF4}$ on a line 356. The reference potential $V_{REF4}$ may be supplied by an adjustable potentiometer 358 having a $+12$ volt source at $+12\ V_{S7}$. A resistor 360 (100K) on line 356 couples the reference potential $V_{REF4}$ to the plus terminal 5 of amplifier 4B. An output terminal 7 is electrically connected to a line 362 for generating potential output from the amplifier 4B. Line 162 is tapped from the line 362 and supports a current steering diode 364 that functions to block further transport of any positive potential signal that may appear from amplifer 4B on line 162. A resistor 366 (10M) connects line 362 to the input line 356 for operational feedback to the amplifier 4B.

In operation, the Crash Protector 158 becomes actively operational when $+I_{IN1}$ on line 106 entering the Constant Current High Voltage Control 94 is an excessively low conducted corona current—far below optimum. Low conducted current on line 106 has zero or very nearly zero voltage which, when summed with the negative bias reference $V_{REF1}$, generates an extremely lowered net negative potential supplied to amplifier 1A at the minus terminal 2. Amplifier 1A is then caused to generate a proportionally higher positive output signal (approximately 12 volts) from output terminal 1 on the line 194. The $+12$ volt potential signal appears on line 160 and is supplied through resistor 354 to the minus input 6 of amplifier 4B. The reference potential $V_{REF4}$ supplied to the plus input terminal 5 of amplifier 4B is preset to have its potential to be less than 12 volts (approximately 8–10 volts). The $+12$ volt signal at minus input terminal 6 is thus greater than the reference potential supplied by $V_{REF4}$ at plus terminal 5 causing amplifier 4B to generate a negatively high potential signal from output terminal 7 on line 362. The negatively high potential signal appearing on line 162 is passed through diode 364 and through resistor 276 of Motor Control 100 to provide the previously described second priority signal (a negative offset potential) for causing the amplifier 2B to generate approximately 12 volts on line 124 utilized in the Motor Control 102 to activate the Motor 104 for moving the upper electrode 86 upwardly to its retracted inactive position (FIG. 1). The reference potential of $V_{REF4}$ is preset to normally be above the potential signal appearing on line 160 from the Constant Current High Voltage Control 94. Amplifier 4B is normally caused to generate a positive signal that is not seen in the Motor Control 100 and allows the Motor Control 100 to generate normally.

Conventional electrical elements comprising the Arc Control block 156 are shown arranged in FIG. 8. This block 156 generally functions to move the upper movable electrode 86 to the retracted position when a high current surge—arcing—occurs along dependent segment 90. To accomplish this, line 164 is tapped from line 152 (FIG. 3) for sensing current at needles 78 of the dependent segment 90. Conducted current on the line 164 $I_{IN3}$ is applied through a resistor 368 (100K) to establish a positive voltage signal proportional to the current $I_{IN3}$ supplied to a minus input terminal 2 of an operational amplifier 3A. This amplifier 3A is also one-half of yet another Low Power Dual Operational Amplifier commercially available under the aforementioned designate LM 358. A line 370 is electrically coupled to a plus terminal 3 of amplifier 3A. A reference potential $V_{REF3}$ is generated on line 370 by an adjustable potentiometer 372 having a +12 volt source at +12 $V_{S3}$. The reference potential signal $V_{REF3}$ is applied through a resistor 374 (100K) prior to entering the plus terminal 3 of amplifier 3A. A capacitor 376 (0.1 μF) and a Zener diode 378 are tapped in parallel relation from the line 164 for clamping the conducted signal $I_{IN3}$ on line 164. A pair of reversed diodes at 380 are in parallel connecting the line 164 to the line 370 across the terminals 2 and 3 of amplifier 3A to afford high voltage protection to amplifier 3A. A line 382 extends from an output terminal 1 of amplifier 3A. Amplifier 3A functions like a comparator in that the reference potential supplied by $V_{REF3}$ at plus input 3 is compared to the voltage signal supplied at minus input 2 to govern amplifier 3A operation. The reference potential of $V_{REF3}$ is selected, such that, when $V_{REF3}$ is compared with the voltage signal from resistor 368 it falls between voltages on line 164 during normal optimum operation and the higher voltages on line 164 caused by arc formation at electrode 86. A feedback resistor 384 (10M) is connected from line 382 to line 370 to control positive feedback operation of the amplifier 3A. Line 382 has a resistor 386 (100K) in series with another resistor 388 (470K). Resistor 388 establishes the potential supplied to a plus input terminal 3 of an operational amplifier 4A. This amplifier 4A is the other half of the conventional LM 358 Dual Amplifier containing the amplifier 4B in the Crash Protector 158. An output terminal 1 of amplifier 4A is electrically coupled to an output line 390 that extends to provice a feedback potential to a minus input terminal 2 for operation of the amplifier 4A. A diode 392 is connected across the resistor 388 and is coupled to cooperate with a capacitor 394 (100 μF) for functioning as a time delay circuit to control the incoming potential signal supplied to the input 3 of amplifier 4A. A resistor 396 (10K) is tapped from line 390 and coupled to the base of a transistor 398. The emitter side of transistor 398 is connected to a diode 400 coupled to ground. The collector side of transistor 398 is connected to the line 166 extending to the Door Interlock block 168.

In normal optimum corona current density operating conditions, approximately 1 volt is generated from resistor 368 supplied to the minus input terminal 2 of amplifier 3A. The plus input terminal 3 is operated by the reference voltage supplied by $V_{REF3}$ which is preset to be about 2 volts. Thus, the $V_{REF3}$ voltage is normally higher than the operating voltage on line 164 and the amplifier 3A is caused to generate a positive high potential from output terminal 1 appearing on line 382. This positive high signal on line 382 is communicated through resistors 386 and 388 to the plus terminal 3 of amplifier 4A. In response to receiving the positive high potential signal from line 382 at input 3, amplifier 4A operates to generate a positive high potential from its output terminal 1 appearing on to the line 390. This positive high potential signal on line 390 causes the transistor 398 to turn ON so that its collector circuits are latched to ground along line 166 coupled to the Door Interlock block 168.

When an arc occurs at segment 90 of electrode 86, the voltage on line 164 from resistor 368 to the minus input terminal 2 of amplifier 3A is relatively high above the 2 volts supplied by the $V_{REF3}$ input at the plus input 3. Amplifier 3A is then operated to generate a relatively low potential signal, compared to the normally high potential signal, on line 382 to the plus input terminal 3 of amplifier 4A. This low potential signal causes the amplifier 4A to generate a low potential signal on its output line 390 which, in turn, switches the transistor 398 to OFF, no current flow therethrough, causing a high potential signal at approximately 12 volts to appear on line 166.

Electrical elements comprising the Door Interlock circuitry block 168 are also shown in FIG. 8. The Door Interlock 168 includes an operational amplifier 3B which forms the other half of the conventional LM 358 component comprising the amplifier 3A in the Arc Control 156. The line 166 from the Arc Control 156 is coupled in series through the door interlock switch 40 and extends therefrom to a plus input terminal 5 of amplifier 3B. The door interlock switch 40 is illustrated closed by the solid line to allow current flow therethrough when the door 20 is shut. The closed switch 40 provides a continuous path to ground for the voltage appearing on line 174 supplied by the +12 $V_{S4}$ source in the Motor Control 100 (FIG. 5). An output terminal 7 of amplifier 3B is electrically coupled to a line 402 extending to the base of a transistor 404. A +12 volt +12 $V_{S6}$ source is provided to supply the collector side of the transistor 404. The emitter side of transistor 404 extends on a line 406 to an electrical junction at 408. Line 176 extends from junction 408 to the clamping circuit 222 in the Constant Current High Voltage Control 94. A line 410 extends from junction 408 coupled to a series resistor 412 (240K) and continues therefrom to a conventional optical isolator 414 component. The optical isolator 414 is a standard known electrical component comprising a light emitting diode 416 illuminously coupled to the base of a phototransistor 418. A suitable optical isolator 414 component is made commercially available by a Motorola manufacturer through their publication entitled Opto Electrical Device Databook, 1981 edition and identified under the designation 4N27. The line 170 is a hot ground coupled to the emitter side of the transistor 418 and extending to the High Voltage Power Supply 96. The line 172 has a resistor 420 (100K) and is coupled to the collector side of transistor 418 from the High Voltage Power Supply 96. Another line 422 extends from junction 408. A line 424 is tapped from line 422 to supply an operational feedback potential to a minus terminal 6 of amplifier 3B when the transistor 404 is latched ON. A capacitor 426 (0.01 μF) and a Zener diode combination 428—two Zener's in opposing relation—are coupled in parallel from line 422 to the line 174 for control of potential signals from junction 408 to line 174.

During normal cooking operation using the enhanced heat and mass transfer apparatus 62, the door interlock switch 40 is in the closed solid line position. Potential on line 166 goes to ground through the transistor 398 in the Arc Control 156 causing the amplifier 3B to be regarded as inactive having no operating output to the base of transistor 404. The transistor 404 is latched OFF and there is no operative output from the emitter.

Amplifier 3B is activated to generate a high, approximately 12 volt, signal on line 402 when the potential on line 166 to the plus terminal 5 of the amplifier 3B reaches 12 volts. This occurs when the continuity of line 166 is interrupted such as occurs when the door interlock switch 40 is opened or when the series transistor 398 in the Arc Control 156 is switched to OFF due, e.g. to arcing at segment 90. 12 Volts of output from amplifier 3B on line 402 causes the transistor 404 to latch ON to generate a 12 volt supply at the junction 408. The 12 volt supply at junction 408 appears on line 410 supplied to the optical isolator 414 causing it to turn ON for allowing current to flow across transistor 418 from line 172 to line 170. Current continuity flowing through lines 172 and 170 is utilized in the High Voltage Power Supply unit 96 to interrupt its power output. Simultaneously, the 12 volt potential at junction 408 is carried on line 176 to the clamping circuit 222 in the Constant Current High Voltage Control 94 for causing the signal on line 108 to go high for discharging capacitor 220 to establish a limited acceptable high voltage turn on supply to the food when high voltage to the food is restored. The 12 volts on line 166 is also carried on line 174 extending to the Motor Control unit 100 wherein the 12 volts from the $+12_{S4}$ source is supplied to amplifier 2B for providing priority over line 256 input to the plus input terminal 5 of amplifier 2B. This causes amplifier 2B to generate a high potential output on line 124 to the Motor Drive 102 wherein the high potential is utilized for causing the movable electrode 86 to move upwardly to the retracted inactive position.

For maximum heat and mass transfer to occur, it will be recalled apparatus 62 operates to maintain the corona current density in the upper electrical field 84 at the found optimum 15 $\mu$A per inch$^2$ having an acceptable tolerance ranging from 5 $\mu$A per inch$^2$ to 25 $\mu$A per inch$^2$ and to maintain the corona current density in the lower electrical field 76 at the differently found optimum 25 $\mu$A per inch$^2$ having an acceptable tolerance ranging from 15 $\mu$A per inch$^2$ to 35 $\mu$A per inch$^2$. Thus, the optimum corona current density applied to the top food surface 82 is different from the found optimum corona current density applied to the bottom food surface 74 at a preferred 3 to 5 ratio. However, the exact corona current density ratio may vary provided each field 84, and 76 supports a corona current density within the disclosed acceptable tolerance range. The reason the two field 84 and 76 have different optimum corona current density values is attributed to factors including gravity, buoyancy and the air temperature differentials existing between the upper food surface 82 and the lower food surface 74. These factors are found to differently effect the heat and mass transfer at opposing food surfaces 82 and 74. Therefore, the disclosed preferred corona current density ratio is employed in order to simultaneously achieve maximum heat and mass transfer at both food surfaces 82 and 74.

Figure 11A:
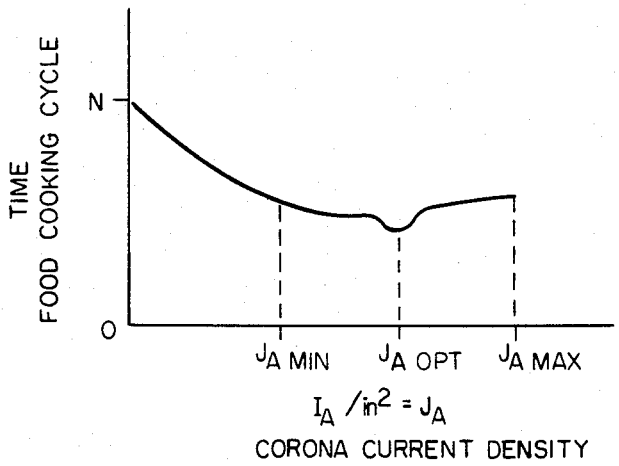
FIG. 11A is a graph showing cooking cycle time in relation to corona current density applied from above the food.
Figure 11B:
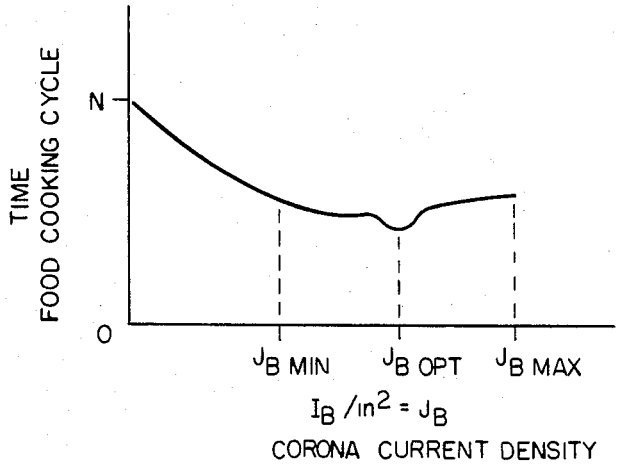
FIG. 11B is a graph showing cooking cycle time in relation to corona current density applied from below the food.
Figure 11C:
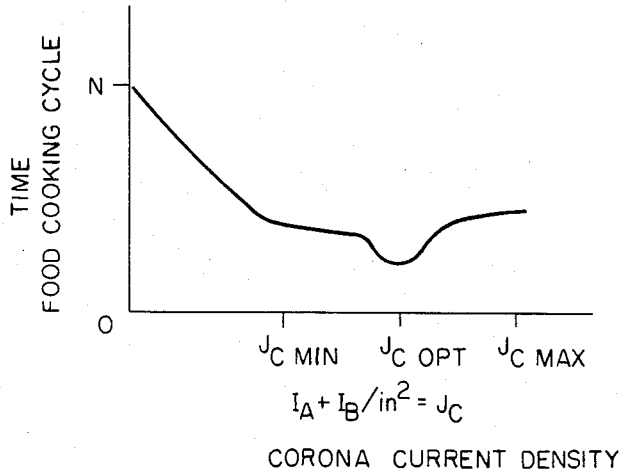
FIG. 11C is a graph showing cooking cycle time in relation to simultaneously applying corona current density from above and below the food.

Employment of the different corona current densities is illustrated in the graphs of FIGS. 11A, 11B and 11C. The graph in FIG. 11A generally illustrates enhanced heat and mass transfer when corona current is applied to only the upper food surface 82. In the graph of 11A food cooking cycle time is shown in relation to corona current density ($I_A$/in$^2$—$I_A$ representing current in the upper field 84). $J_A$ represents corona current density in the upper electrical field 84 and $J_{Amin}$ represents the lower density range limit (5 $\mu$A per inch$^2$), $J_{AOPT}$ represents the optimum density (15 $\mu$A per inch$^2$) and $J_{Amax}$ represent the upper density range limit (25 $\mu$A per inch$^2$). The food cooking time at N represents normal cooking time without application of corona current. It can be seen that the food cooking cycle is reduced as the corona current density applied to the upper food surface 82 is increased. The corona current density at $J_{Amin}$ shows a significantly improved cooking time over the normal cooking time at N. $J_{AOPT}$ shows maximum improvement in that the cooking time is reduced to a limit providing the shortest food cooking cycle being reduced to on the order of 60% of N. As the applied corona current density rises above optimum (moving rightwardly from $J_{AOPT}$), the cooking food time also is found to rise and when the density goes beyond the maximum range limit at $J_{Amax}$, the food cooking time is found to rise out of acceptability.

The graph in FIG. 11B generally illustrates enhanced heat and mass transfer when corona current is applied to only the lower food surface 74. In the graph of 11B food cooking cycle time is shown in relation to corona current density ($I_B$/in$^2$—$I_B$ representing current in the lower field 76). $J_B$ represents corona current density in the lower electrical field 76 and $J_{Bmin}$ represents the lower density range limit (15 $\mu$A per inch$^2$), $J_{BOPT}$ represents the optimum density (25 $\mu$A per inch$^2$) and $J_{Bmax}$ represents the upper density range limit (35 $\mu$A per inch$^2$). The food cooking time at N represents normal cooking time without application of corona current. It can be seen that, like in graph 11A, the food cooking cycle is reduced as the corona current density applied to the lower food surface 74 is increased. The density at $J_{Bmin}$ shows a significantly improved cooking time over the normal cooking time at N. $J_{BOPT}$ shows maximum improvement in that the cooking time is reduced to a limit providing the shortest food cooking cycle being reduced to on the order of 60% of N. As the applied corona current density rises above optimum, the cooking time is also found to rise (moving rightwardly from $J_{BOPT}$) and when the density goes beyond the maximum range limit $J_{Bmax}$, the food cooking time is found to rise out of acceptability.

The graph in FIG. 11C, generally, illustrates enhanced heat and mass transfer when corona current is simultaneously applied to both the upper and the lower food surfaces 82 and 74, respectively. In the graph of 11C food cooking cycle time is shown in relation to the two corona currents ($I_A+I_B$) and $J_c$ represents the two corona current densities operating simultaneously on the food surfaces 82 and 74. $J_C$ is when the two densities are at their lower range limit and shows a significantly improved food cooking time over normal cooking without corona current shown at N. $J_{COPT}$ shows maximized enhanced heat and mass transfer occurring when both fields 84 and 76 are controlled to support optimum corona current density providing the shortest food cooking time cycle, being improved on the order of about 64% below the normal N. As the two corona current densities rise above their optimum (moving rightwardly from $J_{COPT}$), the food cooking time is also found to rise and when the two densities go beyond their maximum range limit $J_{Cmax}$, the food cooking time is found to rise out of acceptability. The graph 11C shows the present enhanced heat and mass transfer application cooking a particular food taking about 36% of its normal N cooking time. Obviously, the mass composition of the food being cooked effects the rate of internal heat and mass conduction. Therefore, the 36% of the normal cooking time is a representation of improvement for one kind of food and other foods will have a differently reduced cooking time. The importance being that optimum corona current density, as disclosed in this application, when applied from above and below the food, maximizes heat and mass transfer at external surfaces of that food to significantly reduce its cooking time.

Figure 9:
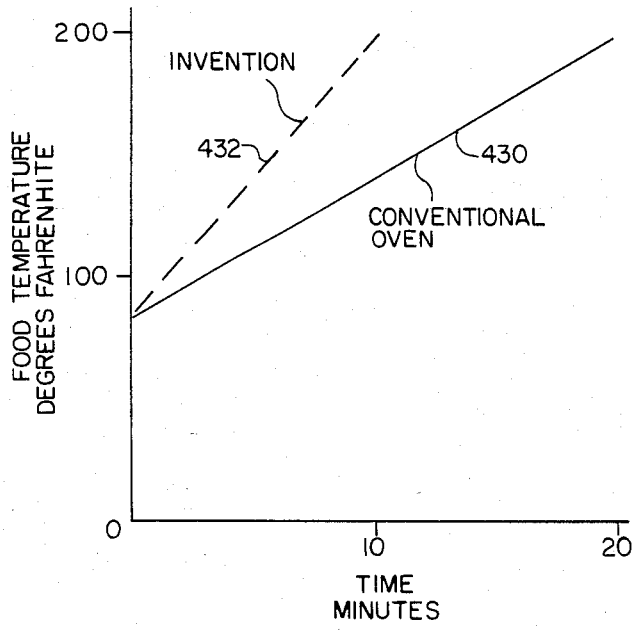
FIG. 9 is a graph showing cooking time in relation to food temperature for comparing the cooking process using conventional cooking elements, and using the present apparatus in conjunction with the conventional cooking element to demonstrate the enhancing heat transfer process accomplished by the present invention.
Figure 10:
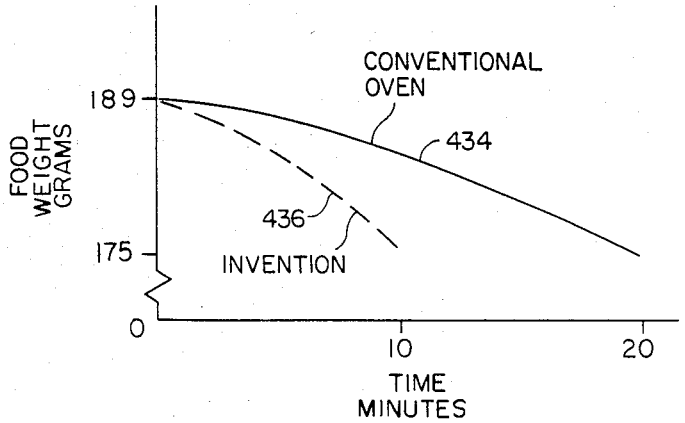
FIG. 10 is a graph showing cooking time in relation to food weight for comparing the two cooking processes of FIG. 9 to demonstrate the enhanced mass transfer accomplished by the present invention.

Referring now to the graphs shown in FIGS. 9 and 10, these graphs illustratively demonstrate enhanced heat and mass transfer accomplished by using the presently disclosed apparatus 62. The graph of FIG. 9 shows enhanced heat transfer and the graph of FIG. 10 shows enhanced mass transfer. It should be pointed out that both graphs (FIGS. 9 & 10) are the result of cooking a like kind of food, specifically a cake, and that similar results have been obtained when cooking other kinds of food. Also, exact test data results have been omitted and the graphic profiles shown in FIGS. 9 and 10 represent a general averaging of the actual results obtained for simplicity sake and because this is all that is necessary to comprehend the improved cooking accomplished from using the disclosed apparatus 62.

In FIG. 9, there is shown a graph illustrating the relationship between time (horizontal) and temperature (vertical) for food being cooked. This relationship is an expression of heat transfer. The solid line 430 represents heat transfer of food being cooked in a conventional oven using the normal heating elements. The dashed line 432 represents heat transfer of food being cooked when using the disclosed apparatus 62. The food cooking cycle of each heat transfer profile 430 and 432 has a food temperature limit at abut 200° (Fahrenheit) whereat the food may be considered cooked. The food cooked in the conventional oven, producing the solid line 430, is shown to take approximately 20 minutes for the food temperature to reach 200° F.The general slope of the line 430 shows a gradual rise in the food temperature from room temperature (approximately 70° F.) to the final 200° F. cooked temperature. The food cooked in the present oven utilizing apparatus 62, producing the dashed line 432, is shown to take approximately 10 minutes for the food temperature to reach 200° F. The relative slope of the line 432 shows a more rapid rise in the food temperature from room temperature to the final 200° F. cooked temperature compared to normal. In comparing the results, the heat transfer line 432 shows a significant improvement over the line 430 with respect to reduced cooking times. In this example, the cooking time is reduced 50% or one-half the normal cycle. Similar improved results have been observed when cooking other kinds of foods.

In FIG. 10, there is shown a graph illustrating the relationship between time (horizontal) and food weight (vertical) for food being cooked. This relationship is an expression of mass transfer in that the food weight loss, in grams, has been monitored during the cooking cycles of FIG. 9. The mass transfer is attributed to evaporating moisture molecules leaving the food. The solid line 434 represents the mass transfer from food being cooked in the conventional oven. Initially this food, line 434, weighed approximately 189 grams and was observed to have a net weight loss of about 14 grams during its 20 minute cooking cycle having a final cooked weight of approximately 175 grams. The dashed line 436 represents the mass transfer accomplished from using the disclosed apparatus 62. Initially this food, dashed line 436, also weighed approximately 189 grams and experienced a net weight loss of about 14 grams during its 10 minute cooking cycle having a final cooked weight of approximately 175 grams. The generally downwardly curved slope of line 434 shows a gradual loss of weight and the downwardly curved slope of the line 436 show a more rapid loss of weight. In comparing the results, the line 436 shows a significant improvement over the line 434 in terms of having an increased rate of weight loss (grams per minute) even though both foods experienced the same weight loss (14 grams). Similar, improved rates of weight loss have been observed when cooking other kinds of foods.

In obtaining the enhanced heat and mass transfer results of FIGS. 9 and 10, the operating apparatus 62 maintained corona current density in field 76 and 84 within their respective optimum disclosed tolerance range throughout the cooking cycle. Corona current densities outside the disclosed respective tolerance ranges cause a departure from the maximum heat and mass transfer rates. Corona current densities below the low tolerance limit of the disclosed ranges are not sufficient to completely disrupt the formation of the thin layer of stagnant air at food surfaces nor to adequately carry freshly heated air to displace air about the food that has given up its thermal energy to the food surfaces. As a result heat and mass transfer is unacceptably below maximum, yet still offering some proportional improvement over conventional ovens. Corona current densities above the high tolerance limit of the disclosed ranges offers the effect of compressing rather than disrupting the film. Thus, the heat and mass transfer rates are restricted towards operating at less than maximum efficiency and cooking times rise.

While the foregoing description has disclosed the preferred embodiment of an enhanced heat and mass transfer apparatus, it will be clear to those skilled in the art that other forms and embodied uses of the present apparatus would be equally applicable. The presently disclosed embodiment is therefore to be considered in all respects as illustrative and not restrictive, the scope of the invention being defined by the appended claims rather than by the foregoing description, and all charges which come within the meaning and range of equivalency of the claims are therefore intended to be embraced therein.

What is claimed is:

1. An apparatus in a food cooking device for enhancing heat and mass transfer between surfaces of food being cooked and ambient air contained within a heat chamber during the cooking process of the cooking device, the apparatus comprising in combination;

a food supporting member fixedly mounted in electrical isolation in the heat chamber;

a variable high voltage power supply having at least a high potential output terminal;

an electrical conducting means including a food engagement member electrically connected to said high potential terminal, said high voltage power supply operable to supply high voltage to the food through said food engagement member engaging the food for maintaining the food at a high potential;

a first electrode means fixed in the heat chamber below the food and having a spaced relation to a bottom surface of the food for defining a first electrical field for supporting corona current;

a circuit voltage control means electrically interposed between said first electrode means and said power supply, said voltage control means electrically connected to said first electrode means for sensing corona current in said first electrical field and to generate a voltage adjusting signal to said power supply to adjust the high voltage output to the food for maintaining the corona current in said first electrical field at a constant optimum corona current density within a range from 15 $\mu A/in^2$ to 35 $\mu A/in^2$ for enhancing heat and mass transfer at said bottom food surface;

a second electrode means movably supported above the food in the heat chamber and having a spaced relation to a top surface of the food for defining a second electrical field for supporting corona current;

a drive means coupled to the second electrode means for adjustively moving said second electrode means towards and away from said top food surface; and an electrode adjusting circuit interposed between said second electrode means and said drive means, said electrode adjusting circuit electrically connected to said second electrode means for sensing corona current in said second electrical field and to electrically control the drive means for adjustively moving said second electrode means for maintaining the corona current in said second electrical field at a constant optimum corona current density within a range from 5 $\mu A/in^2$ to 25 $\mu A/in^2$ for enhancing heat and mass transfer at said top food surface.

2. An apparatus according to claim 1 wherein said first electrode means comprising a plate member having a first segment supporting a first set of electrode needles, a second segment supporting a second set of electrode needles and electrical insulation means interposing said first segment and said second segment for electrically isolating said first set of electrode needles from said second set of electrode needles.

3. An apparatus according to claim 2 wherein said first segment is centrally located on said plate member and constructed of a predetermined area supporting a known number of needles located for complete alignment beneath said bottom food surface.

4. An apparatus according to claim 3 wherein said circuit voltage control means is electrically connected to conduct corona current from said first set of electrode needles to sense the total corona current conducted by said first segment and to generate therefrom said voltage adjusting signal of a proportional relation to the corona current density present in said first electrical field with respect to an optimum corona current density of 25 $\mu A/in^2$.

5. An apparatus according to claim 1 wherein said second electrode means comprising a second plate member having a third segment supporting a third set of electrode needles, a fourth segment supporting a fourth set of electrode needles and a second electrical insulations means interposing said third segment and said fourth segment for electrically isolating said third set of electrode needles from said fourth set of electrode needles.

6. An apparatus according to claim 5 wherein said third segment is centrally located on said second plate member and constructed of a predetermined area supporting a known number of needles located for complete alignment above said top food surface.

7. An apparatus according to claim 6 wherein said circuit electrode adjusting means including a motor control circuit means interposing said second electrode means and said drive means and said motor control circuit means is electrically connected to conduct corona current from said third set of electrode needles to sense the total corona current conducted by said third segment and to control operation of said drive means according to the corona current density present in said second electrical field in relation to an optimum corona current density of 15 $\mu A/in^2$.

8. An apparatus according to claim 1 wherein said first electrode means and said second electrode means individually comprising a plate member having a pair of segments and electrical insulation means interposed between said pair of segments.

9. An apparatus according to claim 1 further comprising:

a motor control circuit of said electrode adjusting means electrically coupled to control operation of said drive means for moving said second electrode means;

said circuit voltage control means electrically connected to conduct corona current from said first electrode means; and a crash protector circuit electrically connected to said circuit voltage control means for receiving therefrom an electrical signal representative of the conducted corona current in said first electrical field and electrically connected to said motor control circuit for causing said drive means to move said second electrode means away from the food in response to receiving the electrical signal representing the corona current in said first electrical field advancing towards zero.

10. An apparatus according to claim 9 further comprising an arc control circuit electrically connected to conduct current from said second electrode means and electrically connected to said motor control circuit for causing said drive means to move said second electrode means away from the food in response to said arc control circuit conducting high current representative of an arc formation in said second electrical field.

11. An apparatus according to claim 10 further comprising a door interlock circuit electrically connected to said arc control circuit through a door interlock switch operable by an oven door and having a first output electrically connected to said circuit voltage control means and a second output electrically connected to said motor control circuit for interrupting electrical power from said power supply and for moving said second electrode means away from the food when said oven door is opened and when said arc control circuit is conducting high current due to an arc formation in said second electrical field when said oven door is closed.

12. An apparatus according to claim 11 wherein said circuit voltage control means including a voltage clamping circuit electrically coupled to said first output of said door interlock circuit for control of said voltage adjusting signal to prevent a sudden high voltage surge to said power supply when an interruption of electrical power to said high voltage power supply is restored.

* * * * *